US011185172B2

(12) United States Patent
Mu

(10) Patent No.: US 11,185,172 B2
(45) Date of Patent: Nov. 30, 2021

(54) CRIB AND APPLICATION METHOD THEREOF

(71) Applicant: Redline Commerce Inc., City of Industry, CA (US)

(72) Inventor: Mengmeng Mu, Ningbo (CN)

(73) Assignee: Redline Commerce Inc., City of Industry, CA (US)

( * ) Notice: Subject to any disclaimer, the term of this patent is extended or adjusted under 35 U.S.C. 154(b) by 0 days.

(21) Appl. No.: 17/001,691

(22) Filed: Aug. 25, 2020

(65) Prior Publication Data

US 2020/0383494 A1 Dec. 10, 2020

Related U.S. Application Data

(63) Continuation of application No. 16/252,683, filed on Jan. 20, 2019, now Pat. No. 10,952,543.

(51) Int. Cl.

| | |
|---|---|
| ***A47D 9/00*** | (2006.01) |
| ***A47D 7/00*** | (2006.01) |
| ***A47D 7/04*** | (2006.01) |

(52) U.S. Cl.

CPC ..... *A47D 9/00* (2013.01); *A47D 7/005* (2013.01); *A47D 7/04* (2013.01)

(58) Field of Classification Search

CPC . A47D 9/00; A47D 7/04; A47D 7/005; A47D 1/006; A47D 11/005; A47D 13/02; A47D 13/066; A47D 7/02; A47D 7/002; A47D 9/005

USPC ..... 5/93.1, 93.2, 95, 99.1, 100

See application file for complete search history.

(56) References Cited

U.S. PATENT DOCUMENTS

| | | | | |
|---|---|---|---|---|
| 2016/0106226 | A1* | 4/2016 | Yi | A47D 9/00 5/11 |
| 2017/0238721 | A1* | 8/2017 | Damiani | A47D 7/02 |
| 2018/0206652 | A1* | 7/2018 | Gallina | A47D 9/04 |

FOREIGN PATENT DOCUMENTS

| | | | | |
|---|---|---|---|---|
| WO | WO-2016012955 A1 * | 1/2016 | | A47D 7/02 |

OTHER PUBLICATIONS

Chicco, "Next2Me Air" Product Manual, 2017, 46079620_1921, 5-6, 21-23 (Retrieved from: https://www.chicco.co.uk/content/dam/chicco/gb/pdf/sleeptime-and-relaxation/pillows-bed-sheets-and-blankets/8058664121243/Chicco_Next2Me_Air_079620_1921.pdf) (Year: 2017).*

"Chicco Next2Me: How to guide and features video", Feb. 25, 2014, Online4Baby (Retrieved from YouTube: https://www.youtube.com/watch?v=AlzvB6D-b6A) (Year: 2014).*

* cited by examiner

*Primary Examiner* — Eric J Kurilla
(74) *Attorney, Agent, or Firm* — Raymond Y. Chan; David and Raymond Patent Firm

(57) ABSTRACT

A crib adapted for using alongside with a bed includes a frame body which has an upper frame, a lower frame adapted for standing on a ground, a plurality of supporters coupled between the upper frame and the lower frame, and a supporting frame which is supported on the supporters; a bed cover detachably coupled to the upper frame and supported by the supporting frame for defining a receiving cavity above the supporting frame; and a supporting unit coupled to the frame body for abutting a side of the bed to avoid or reduce a gap between the crib and the bed.

14 Claims, 19 Drawing Sheets

CRIB AND APPLICATION METHOD THEREOF

CROSS REFERENCE OF RELATED APPLICATION

This application is a Continuation application that claims the benefit of priority under 35 U.S.C. § 120 to a non-provisional application, patent application Ser. No. 16/252,683, filed Jan. 20, 2019, which is a non-provisional application that claims the benefit of priority under 35 U.S.C. § 119 to a China application number 201810896145.2, filed Aug. 8, 2018, which are incorporated herewith by references in their entireties.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a crib, and more particular to a crib and application method thereof.

Description of Related Arts

A crib provides a relatively independent and safe place for a child during infancy and childhood. Children between the ages of 0 to 3 spend most of their times on the cribs. It is apparent that the cribs are definitely important for infants and younger children.

Existing wooden crib generally has a higher fence to prevent the infant rolling and falling from the crib when they creep on the mattress in the crib. For parents of infants, when sleeping at night, it is difficult to observe the activity status of infants because of the barrier effect of the fence; and for infants, once they wake up, it is impossible to observe the parents because of the barrier effect of the fence, thus may cause them to cry.

Further, with the improvement of quality of life, the parents may travel with infants together on holidays. A typical wooden crib generally has a relatively large volume and heavy weight to provide a relatively large activity place for infants and for its own stability, and it means that the crib is limited by its size or weight and may not be portable to be carried out, so it causes trouble for the consumers' travels.

For infant products, parents or other consumers should first consider the safety of infants when purchasing goods, because children at this stage do not have the ability to protect themselves and may get injury because of the negligence of the parents or the insecurity of the surrounding items. At present, reports on the safety of cribs are endless, and even some infants have lost their lives. How to provide a convenient crib while ensuring the safety of infants and young children is a question worth considering.

SUMMARY OF THE PRESENT INVENTION

The invention is advantageous in that it provides a crib and application thereof, wherein the crib is a foldable crib for infant or pet that is able to be folded after use to reduce the space occupied.

Another advantage of the invention is to provide a crib and application thereof, wherein the foldable crib for infant or pet is able to be used alongside with a bed for parent or pet owner to obverse the infant or the pet in the crib at any time.

Another advantage of the invention is to provide a crib and application thereof, wherein at the state of the bedside usage, the crib is able to be steady fixed alongside with the bed.

Another advantage of the invention is to provide a crib and application thereof, wherein the crib in the bedside usage state is able to provide a supporting area for avoiding a gap between the crib and the bed to be beyond a certain range, so as to avoid getting stuck of the infants.

Another advantage of the invention is to provide a crib and application thereof, wherein the height of the crib is able to be adjusted freely within a predetermined range.

Another advantage of the invention is to provide a crib and application thereof, wherein the height of the crib is able to be adjusted freely within a predetermined range to adapt beds of different heights.

Another advantage of the invention is to provide a crib and application thereof, wherein the crib has a fully extended state in which the crib is able to be placed at various locations for use.

Another advantage of the invention is to provide a crib and application thereof, wherein one side of the foldable crib is able to be folded downwardly to switch to the bedside usage state.

Another advantage of the invention is to provide a crib and application thereof, wherein one side of the foldable crib is able to be folded downwardly and can be fixed then for switching to the bedside usage state.

Another advantage of the invention is to provide a crib and application thereof, wherein the foldable side of the foldable crib is able to be locked in position to avoid accidental touches causing sudden drops thereof.

Additional advantages and features of the invention will become apparent from the description which follows and may be realized by means of the instrumentalities and combinations particular point out in the appended claims.

According to the present invention, the foregoing and other objects and advantages are attained by a crib, adapted for using alongside with a bed, comprising:

a frame body which has an upper frame, a lower frame adapted for standing on a ground, a plurality of supporters coupled between the upper frame and the lower frame, and a supporting frame which is supported on the supporters;

a bed cover detachably coupled to the upper frame and supported by the supporting frame for defining a receiving cavity above the supporting frame; and a supporting unit coupled to the frame body for abutting a side of the bed.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
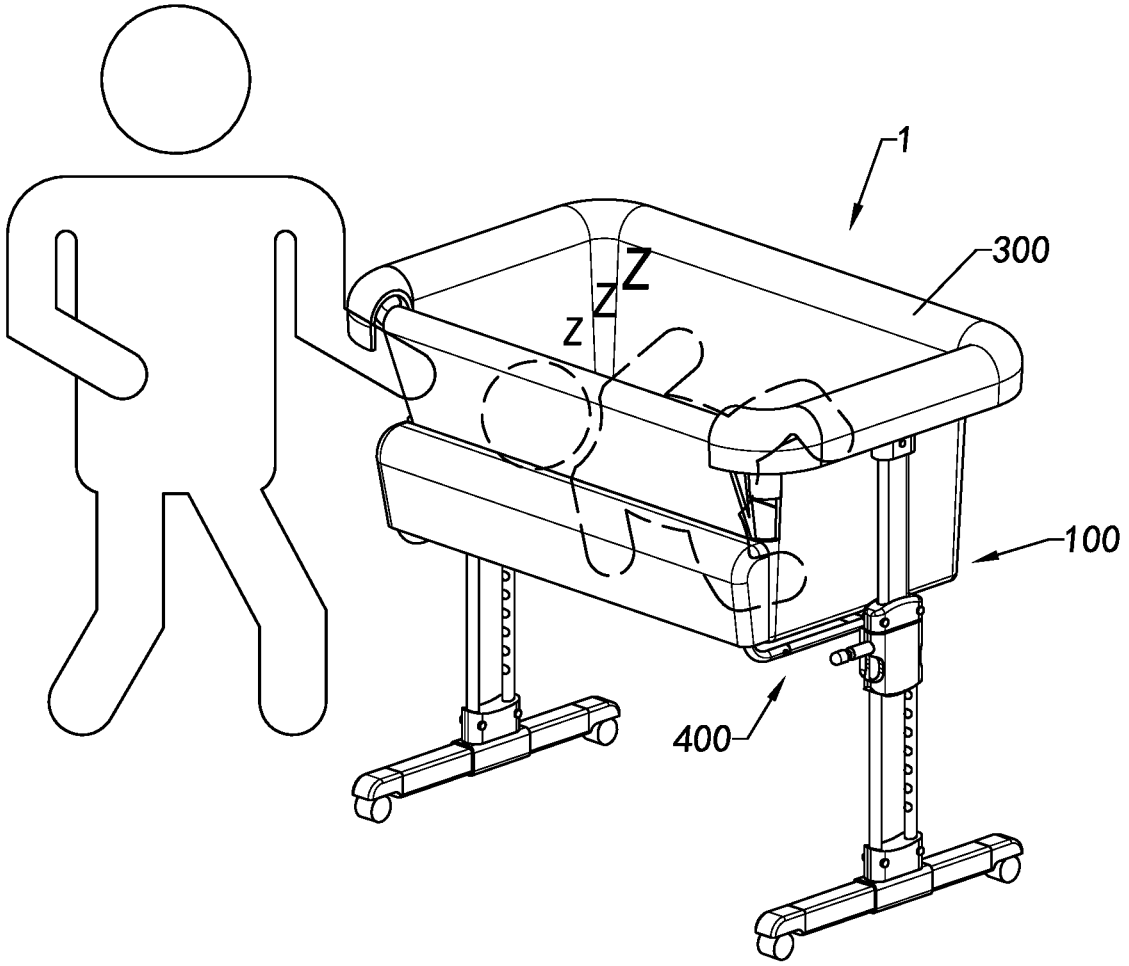
FIG. 1 is a perspective view of a crib according to a preferred embodiment of the present invention.
Figure 2:
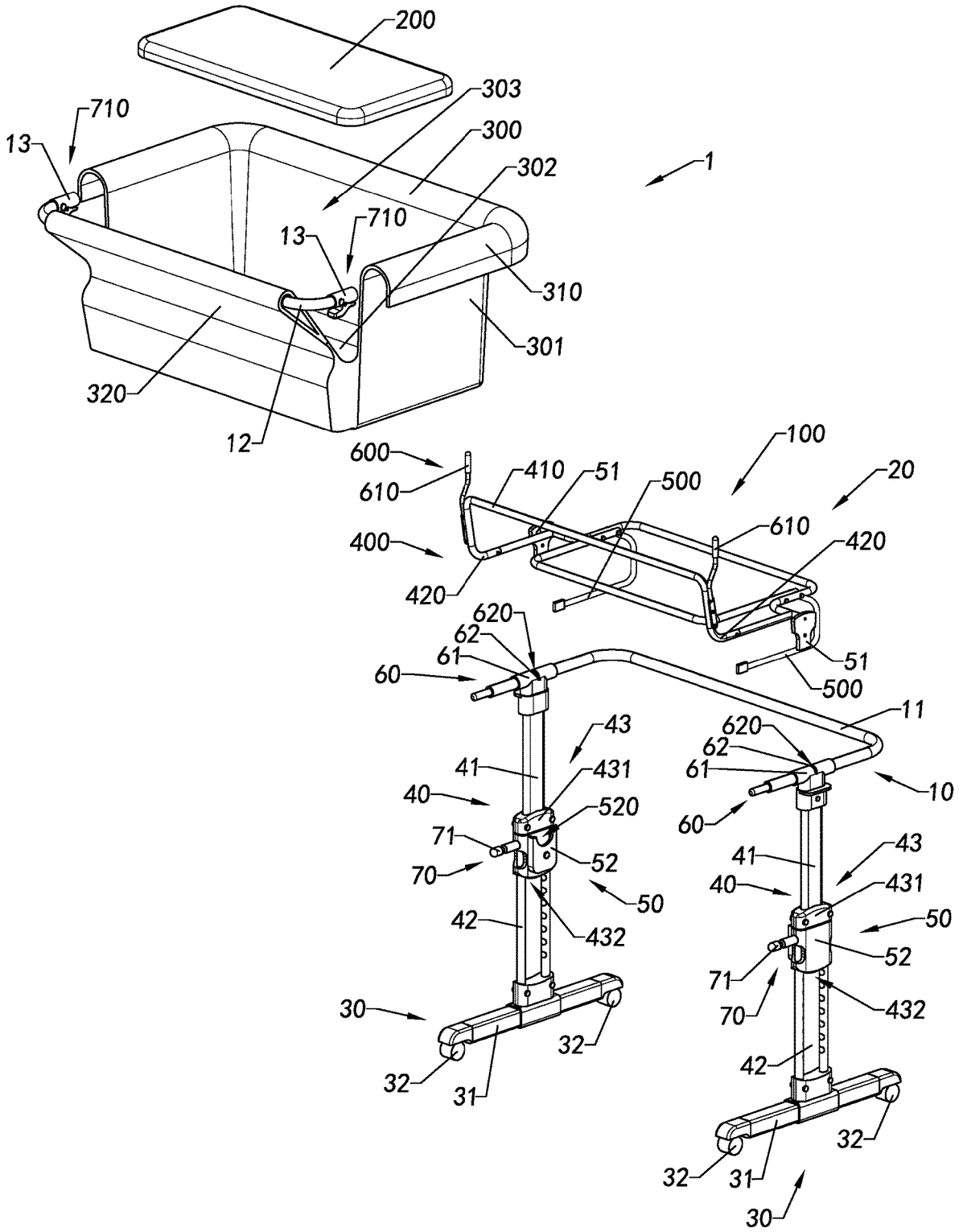
FIG. 2 is an exploded perspective view of the crib according to the above preferred embodiment of the present invention.
Figure 3A:
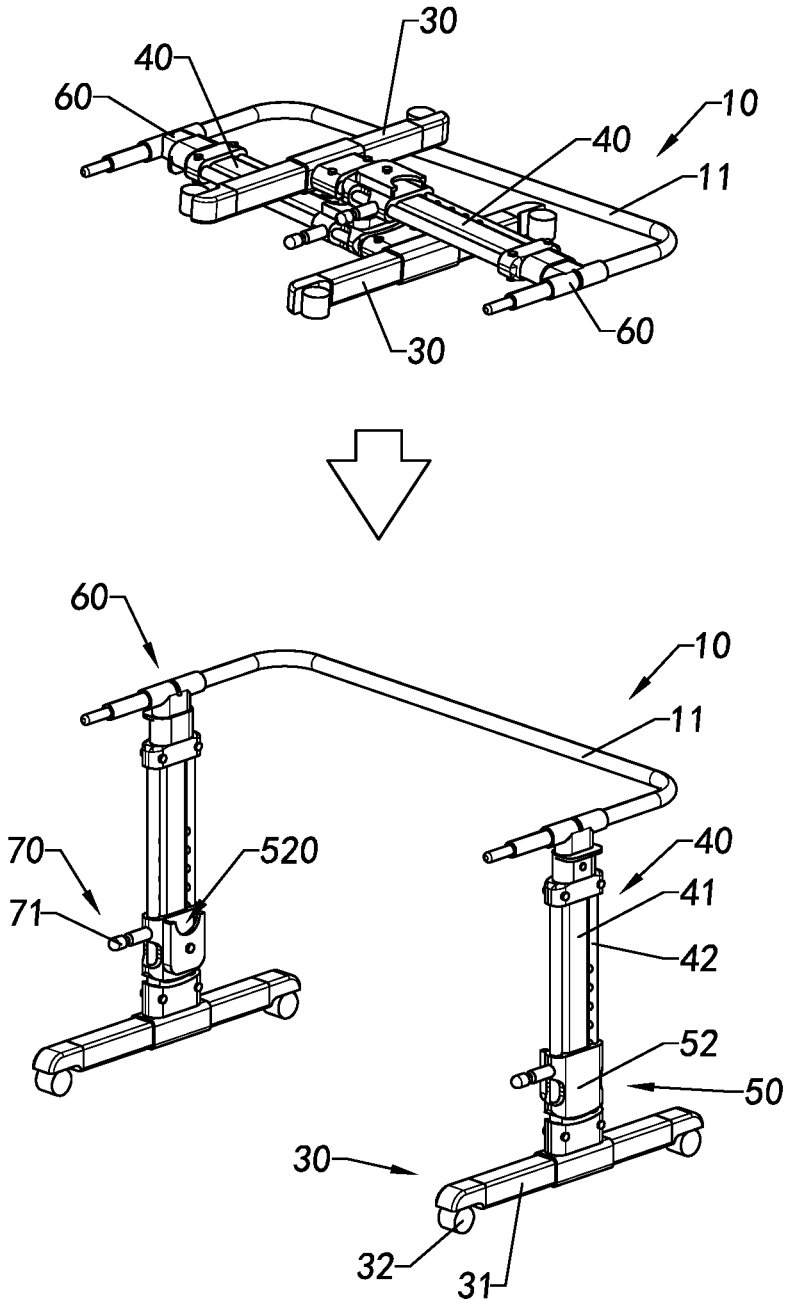
FIGS. 3A to 3F are schematic views illustrating the assembling process of the crib according to the above preferred embodiment of the present invention.
Figure 3B:
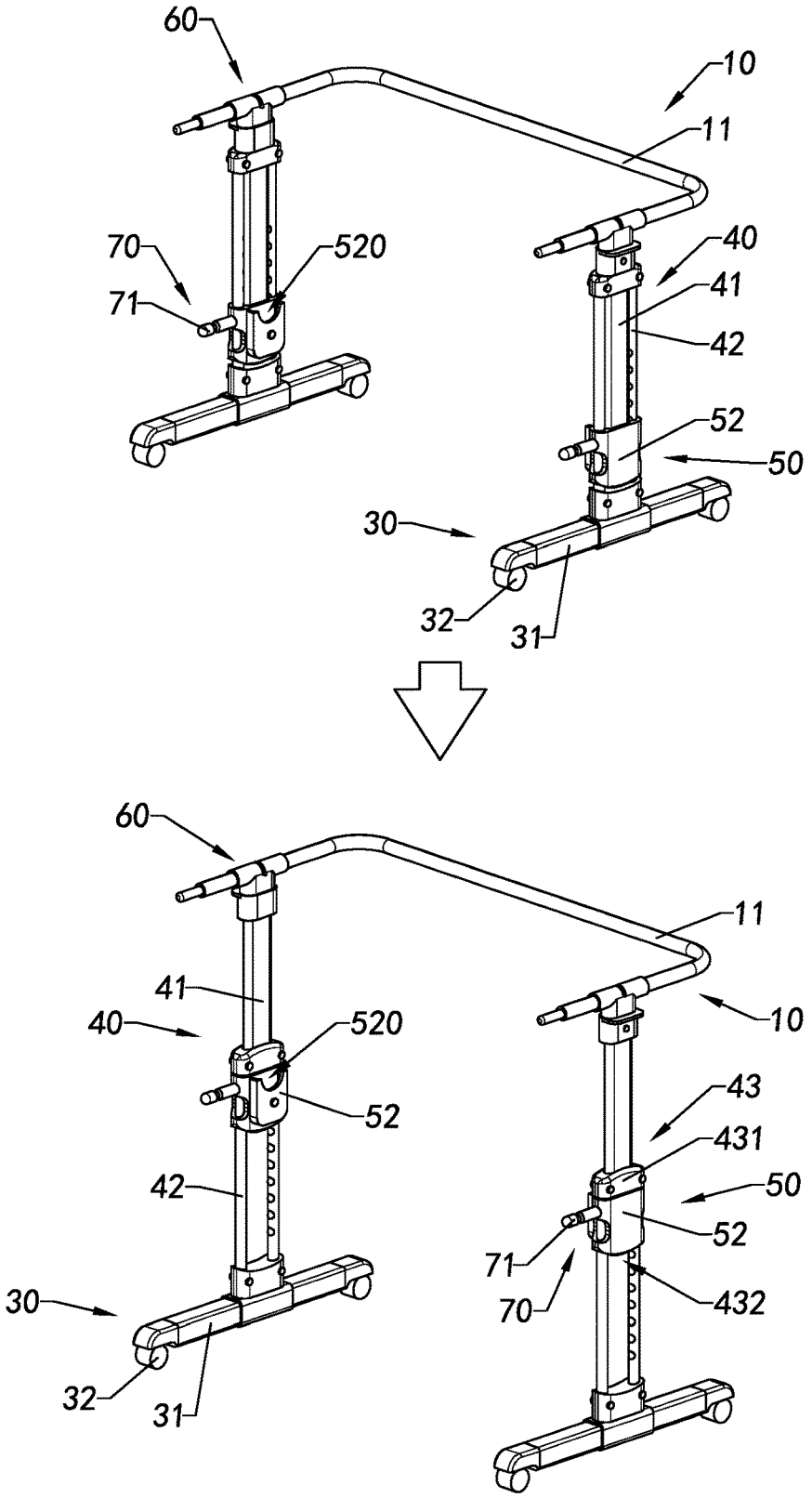
Figure 3C:
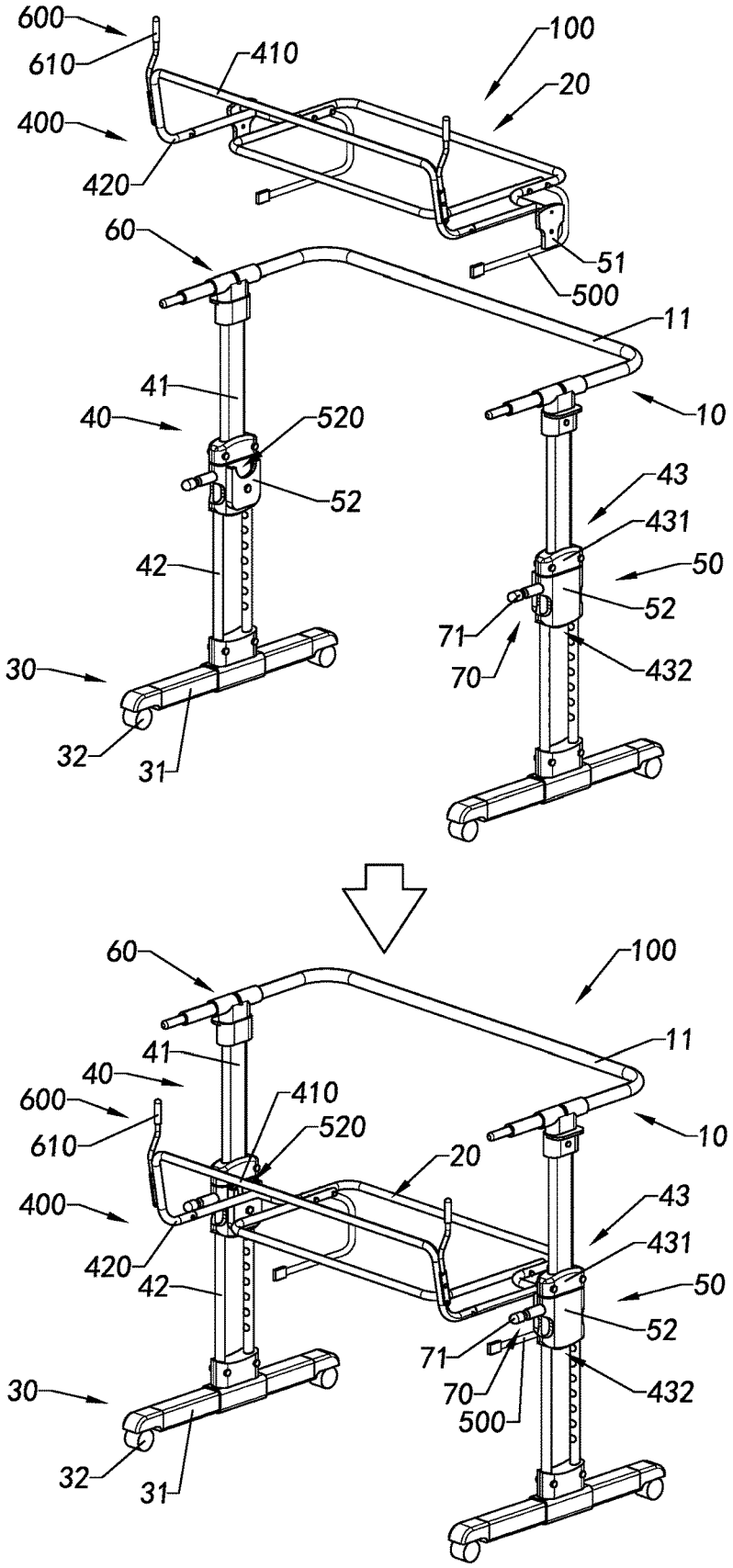

Referring to FIG. 1 and FIG. 2 of the drawings, a crib 1 according to a preferred embodiment of the present invention is illustrated. The crib 1 for infant or pet has a fully extended state as shown in FIGS. 1 and 3E-5B, in which the crib 1 is able to provide a steady support, and a folded state as shown in FIG. 3A, in which the size of the crib 1 is able to be reduced for transporting and carrying conveniently.

Specifically, the crib 1 comprises a frame body 100 comprising an upper frame 10, a supporting frame 20, a lower frame 30 and two or more supporters 40. The two supporters 40 according to the preferred embodiment are respectively located at two sides to support the upper frame 10 and the supporting frame 20. It is worth mentioning that the supporters 40 also may be inclinedly or vertically extended. The lower frame 30 is configured for standing on the ground and used for supporting the supporters 40 on the ground, so that the crib 1 is able to be stably supported on the ground. The upper frame 10 can be used as handrails, such that the user is able to support his or her hand or body on the upper frame 10 while caring for an infant accommodating in the crib 1. The supporting frame 20 is configured for supporting a mattress, and then supporting the infant placidly through the mattress. The supporters 40 are arranged to be extended along a height direction to support the upper frame 10 and the supporting frame 20 at a position of a predetermined height. The lower frame 30 is used for steadily supporting the upper frame 10, the supporting frame 20 and the supporters 40 on the ground.

Each of the supporters 40 has a high end and a low end, and the location of the high end of each supporter 40 is high than the location of the low end. The upper frame 10 is supported at each of the high ends of the supporters 40, while the lower end of each of the supporters 40 is supported at the lower frame 30. The supporting frame 20 is located between the upper frame 10 and the lower frame 30, that is, along the height direction, the location of the supporting frame 20 is lower than the location of the upper frame 10 and higher than the location of the lower frame 30. The supporters 40 are respectively located at two sides of the upper frame 10 and the supporting frame 20 to steadily support the upper frame 10 and the supporting frame 20.

Further, in this embodiment, the supporting frame 20 is detachably connected to the two supporters 40 for conveniently disassembling or installing the supporting frame 20 and the two supporters 40.

The frame body 100 comprises one or more first attachment devices 50, embodied as two first attachment devices 50 according to the preferred embodiment, each of the two first attachment devices 50 comprises a first engaging member 51 and a second engaging member 52 having an engaging cavity 520, wherein the first engaging member 51 is engaged in the engaging cavity 520 of the second engaging member 52. In this embodiment, the two first engaging members 51 of the two first attachment devices 50 are respectively provided on both sides of the supporting frame 20, while the second engaging members 52 of the two first attachment devices 50 are respectively provided at the supporters 40.

Preferably, each first engaging member 51 is vertically and downwardly extended from the supporting frame 20, and the engaging cavity 520 is formed in a vertical direction to install the supporting frame 20 to the supporters 40 conveniently under a force of gravity when each first engaging member 51 is positioned above each corresponding second engaging member 52.

In other alternative modes, the first engaging members 51 are respectively disposed on the supporters 40, and the second engaging members 52 are disposed on both sides of the supporting frame 20. Preferably, each second engaging member 52 is vertically and downwardly extended from the supporting frame 20, and the engaging cavity 520 of each second engaging member 52 is formed in a vertical direction to conveniently connect the supporting frame 20 on the supporters 40 under the force of gravity when each second engaging member 52 is aligned with each corresponding first engaging member 51.

Further, the supporters 40 are configured to be retractable to adjust a height thereof for meeting consumer demands of different heights of the crib 1.

Specifically, each of the supporters 40 comprises an upper upright member 41 and a lower upright member 42, wherein at least a portion of the upper upright member 41 is located higher than the lower upright member 42. The upper upright member 41 is slidably coupled to the lower upright member 42 and can be fixed after the sliding movement. The upper frame 10 is connected to the upper upright members 41, and when the supporting frame 20 is connected to each upper upright member 41, the distance between the two upper upright members 41 and the two lower upright members 42 is changed, wherein the position of the upper frame 10 and the supporting frame 20 with respect to the ground or the lower frame 30 is also changed so that the height positions of the upper frame 10 and the supporting frame 20 are changed.

It can be understood that the distance between the upper frame 10 and the supporting frame 20 does not change during this process. The upper frame 10 and the supporting frame 20 are fixedly coupled to the upper upright members 41.

More specifically, each of the supporters 40 further comprises an adjusting device 43 which is provided at a lower portion of the corresponding upper upright member 41 and is sleeved with the corresponding lower upright member 42, and the adjusting advice 43 is able to be slid upwardly and downwardly along the corresponding lower upright member 42 to change the relative position between the upper upright member 41 and the lower upright member 42. Each of the adjusting device 43 comprises an adjusting body 431 and a push button 432 which is provided on the adjusting body 431. The adjusting device 43 has a locked state in which the upper upright member 41 is fixed on the lower upright member 42 and an adjustable state in which the upper upright member 41 is able to be upwardly and downwardly slid along the lower upright member 42, the push button 432 can be used to switch the adjusting device 43 from the locked state to the adjustable state, or the adjusting device 43 can be switched from the adjustable state to the locked state.

Each of the upper upright member 41 has a high end and a low end, wherein the location of the high end of the upper upright member 41 is higher than the location of the low end of the upper upright member 41. The lower upright member 42 has a high end and a low end, wherein the high end of the lower upright member 42 is located higher than the low end of the lower upright member 42.

Optionally, a length of the upper upright member 41 is less than or equal to a length of the lower upright member 42 so that the upper upright member 41 is able to be totally coincident and overlapped with the lower upright member 42 in the height direction. Of course, the length of the upper upright member 41 may also be larger than the length of the lower upright member 42.

Further, the supporters 40 are connected to the upper frame 10 in such a manner that the supporters 40 can be folded toward the upper frame 10. When the crib 1 is in the fully extended state, the angle between the supporters 40 and the upper frame 10 is 90 degrees, and the supporters 40 are able to be inwardly folded to cause the angel between the supporters 40 and the upper frame 10 to be reduced.

The frame body 100 comprises a plurality of second attachment devices 60 each of which is located between the upper frame 10 and the supporters 40. Each second attachment device 60 comprises a connecting body 61 which is designed as a T-shaped structure for connecting the upper frame 10 and the corresponding supporters 40. The upper end of the connecting body 61 is sleeved on the upper frame 10, and the lower end of the connecting body 61 is sleeved on one of the supporters 40.

More specifically, the upper upright member 41 of each of the supporters 40 is fixed to the connecting body 61, the upper frame 10 is rotatably connected to the connecting body 61 such that the upper frame 10 is rotatably connected to the connecting body 61.

When the supporting frame 20 is coupled to the supporters 40, the relative rotation between the supporters 40 and the upper frame 10 is prevented by the supporting frame 20. When the supporting frame 20 is detached from the supporters 40 and the supporters 40 are inwardly and slightly pushed by the user, the supporters 40 can be folded toward the upper frame 10.

Each second attachment device 60 further comprises a retaining member 62 and has a retaining guide groove 620 which is formed in the connecting body 61 and matched with the retaining member 62, wherein the retaining member 62 is telescopically disposed on the upper frame 10 and retained in the retaining guide groove 620. In the normal state, the retaining member 62 is protruded from the retaining guide groove 620 to limit the rotation angle between the connecting body 61 and the upper frame 10. For example, during the process of mounting the supporting frame 20 on the supporters 40, the inward rotation of the supporters 40 under the force from the upper frame 10 which hinders against the installation of the supporting frame 20 is limited by the retaining member 62. In case of folding the crib 1 for storing and transportation, the retaining member 62 is able to be pushed inwardly so as not to affect the rotation between the connecting body 61 and the upper frame 10.

In other examples of the invention, each of the supporters 40 can be foldably connected to the upper frame 10. The supporters 40, themselves, can be folded. For instance, the upper end of the upper upright member 41 of each of the supporters 40 is configured to be foldable such that the remaining portions of the supporters 40 can be inwardly folded.

In such manner, the supporters 40 and the lower frame 30 connected to the lower end of the supporters 40 can be located at substantially the same height as the upper frame 10, thereby greatly reducing the height of the crib 1 to allow the folded crib 1 to be placed in a relatively flat storage bag for transportation.

Furthermore, the crib 1 comprises a mattress 200 and a bed cover 300 which is detachably coupled to the frame body 100 to increase the aesthetics and comfort of the frame body 100. It is worth mentioning that the bed cover 300 can also form a surrounding wall 301 comprising a foldable side cover 320 and a bottom wall 302 under the support of the frame body 100, wherein the bottom wall 302 is surrounding by the surrounding wall 301, a high end of the surrounding wall 301 is connected to the upper frame 10, and a lower end of the surrounding wall 301 is connected to the supporting frame 20, such that the infant can be prevented from falling off the crib 1 by the surrounding wall 301. The mattress 200 is detachably mounted above the bottom wall 102 of the bed cover 300, and the mattress 200 is supported by the supporting frame 20.

In addition, referring to FIGS. 4C to 5B, the crib 1 also has a bedside usage state. Specifically, in various needs, the crib 1 needs to be placed alongside with the parent's bed 2, for example, for the convenience of looking after the infant, or facilitating the mother who is conveniently lying on the bed 2 to pick up the body to breastfeed the baby.

Figure 4A:
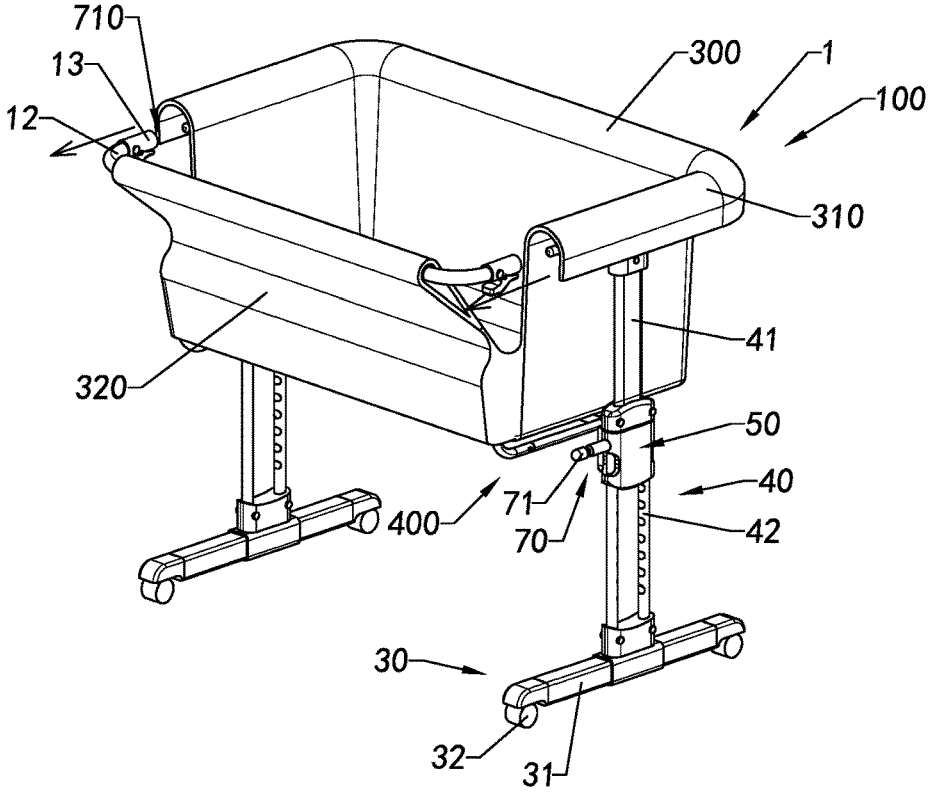
FIGS. 4A to 4D are schematic views illustrating the application process of the crib according to the above preferred embodiment of the present invention.
Figure 4B:
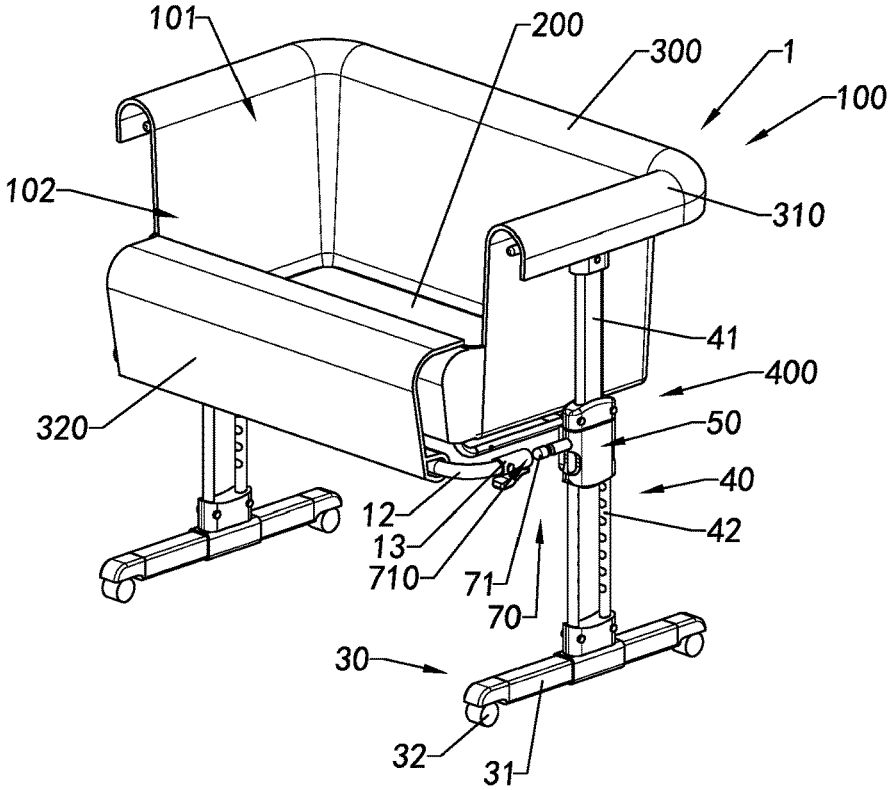
Figure 4C:
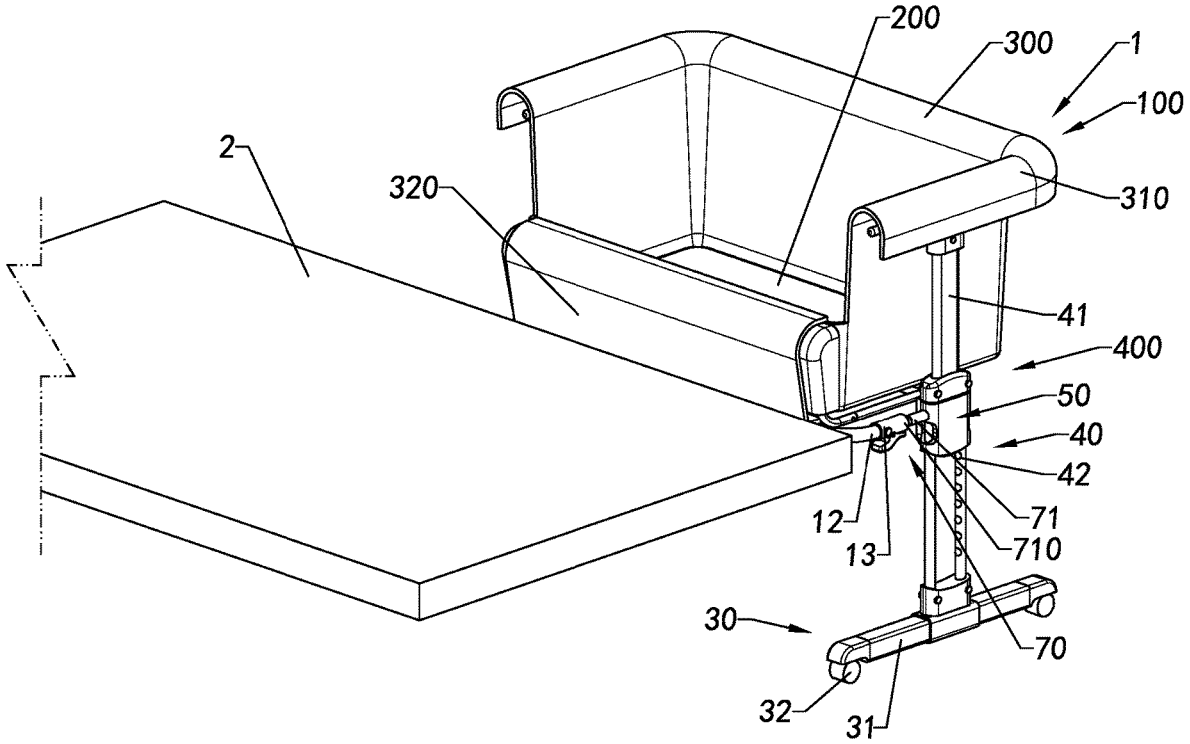

At the bedside usage state, the side cover 320 of the surrounding wall 301 of the bed cover 300 of the crib 1 that is facing the bed 2 can be downwardly folded to lower the height of the surrounding wall 301 of that side to avoid obstruction, as shown in FIGS. 4A to 4C. At the same time, this side cover 320 can be firmly attached to the bed 2 to prevent the infant's hand getting struck in the gap between the crib 1 and the bed 2 after the height of the surrounding wall 301 is lowered.

Specifically, in the above embodiment, at least a portion of the surrounding wall 301 towards the side of the crib 1, i.e. the side cover 320 according to this embodiment, is able to be folded downward to form a side opening 102. In other words, the bed cover 300 comprises a bed cover body 310 and the side cover 320, wherein the side cover 320 can be downwardly folded to form the side opening 102 and connected to the bed cover body 310, for example the side cover 320 can be connected to the bed cover body 310 through a connector such as zipper.

The crib 1 further comprises a supporting unit 400 and a fixing unit 500. The fixing unit 500 is used for fixing the crib 1 and the bed 2 to avoid the relative displacement between the crib 1 and the bed 2. The supporting unit 400 comprises a supporting area, wherein the supporting area is capable of abutting a side of the bed 2 to avoid creating a gap between the crib 1 and the bed 2 which is beyond a certain range.

The fixing unit 500 may be one or more fastening tapes or fastening cords, and the fixing unit 500 can be detachably fixed to the bed 2. The fixing unit 500 may be located on the supporting frame 20 of the frame body 100, or may be disposed on the supporters 40, or may be disposed on the lower frame 30 or the upper frame 10.

In the present embodiment, as shown in FIGS. 4D to 5B, the fixing unit 500 is fixed and coupled to the supporting frame 20, and after the bed cover 300 covers the supporting frame 20, the fixing unit 500 is able to be pulled out and fixed to the bed 2.

The supporting unit 400 is formed on one side of the supporting frame 20, and two ends of the supporting unit 400 are respectively connected to both ends of the supporting frame 20. In this embodiment, the supporting unit 400 can support not only the bed 2 but also the side cover 320 of the bed cover 300.

Figure 3D:
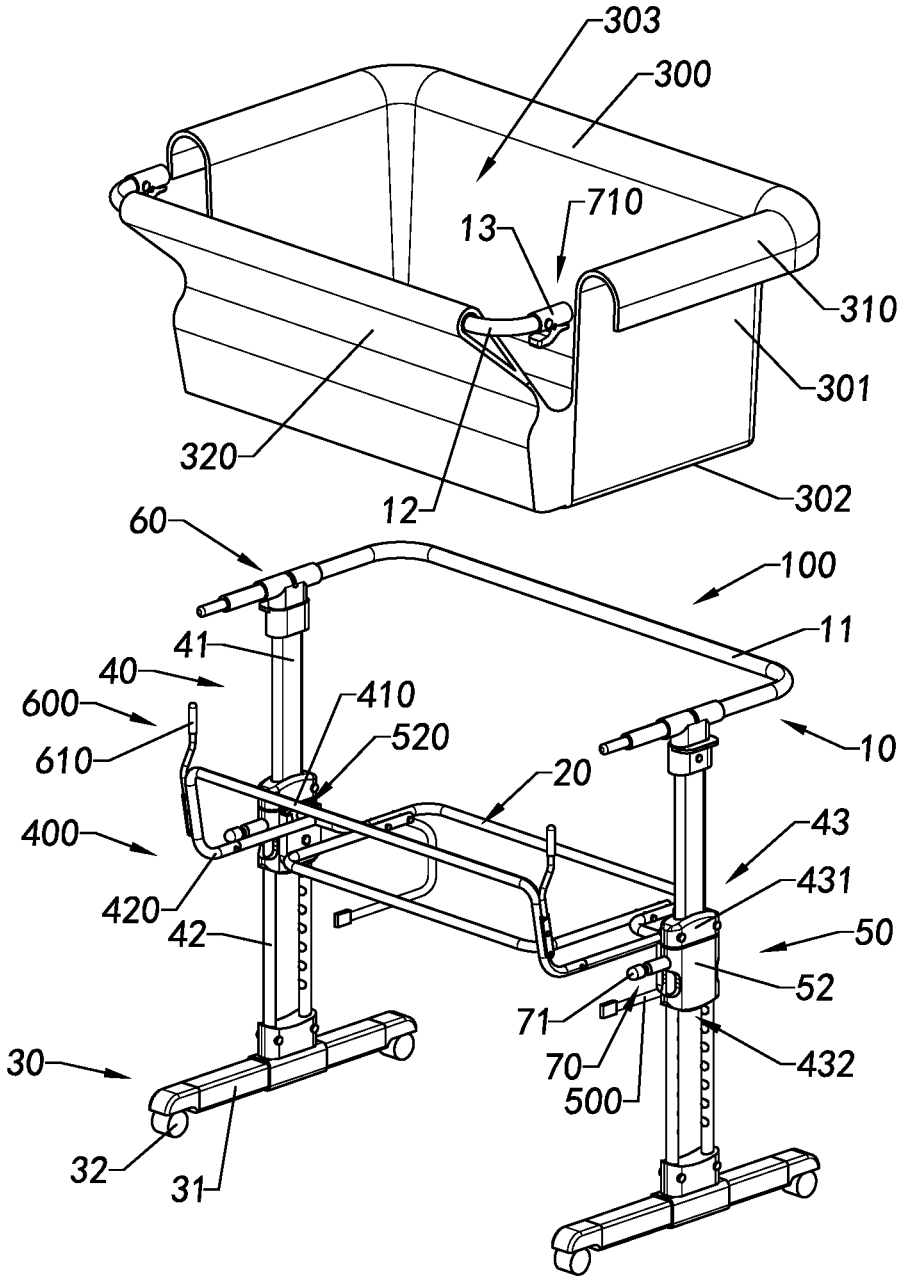
Figure 3E:
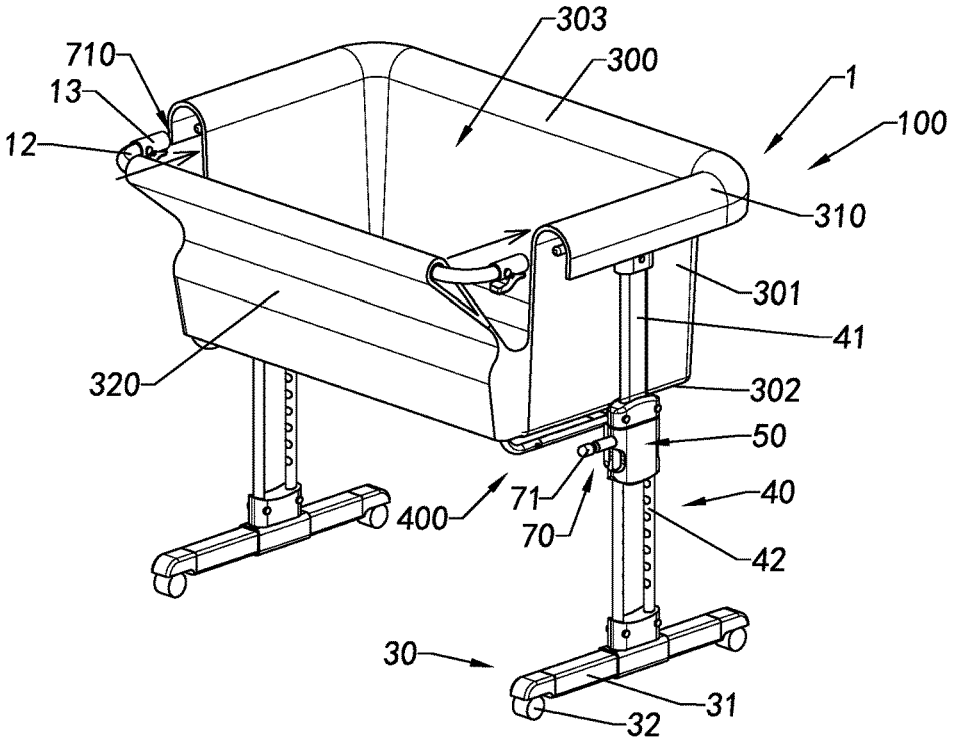
Figure 3F:
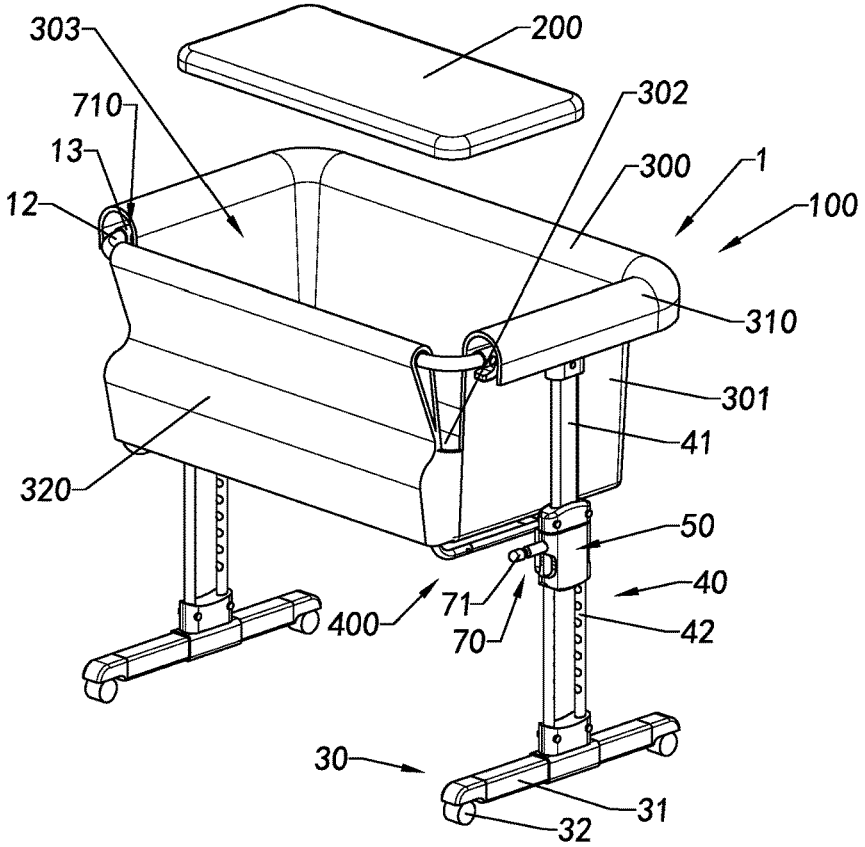

Specifically, referring to FIGS. 2 to 3D, the supporting unit 400 comprises a supporting crossbar 410 and two supporting arms 420, wherein the supporting arms 420 support the supporting crossbar 410 to the supporting frame 20. The supporting crossbar 410 is connected between the two supporting arms 420.

The supporting arms 420 are outwardly and then upwardly extended from the supporting frame 20. In this embodiment, the supporting arms 420 are outwardly extended from the supporting frame 20, and then are inclinedly and upwardly extended to the supporting crossbar 410. In this embodiment of the present invention, the supporting crossbar 410 is formed with a supporting area.

In the other embodiments of the present invention, the supporting arms 420 are outwardly extended from the supporting frame 20, and then are vertically and upwardly extended to the supporting crossbar 410.

The upper frame 10 comprises an upper frame body 11 and a side frame 12, wherein the side frame 12 of the upper frame 10, the bed cover 300 and the supporting unit 400 are located on the same side. The side frame 12 of the upper frame 10 is detachably connected to the upper frame body 11. The side cover 320 of the bed cover 300 is connected to the side frame 12 of the upper frame 10. The side frame 12 of the upper frame 10 is located above the supporting unit 400.

When the crib 1 is switched from the fully extended state to the bedside usage state, the side frame 12 of the upper frame 10 is first detached from the upper frame body 11 and then is downwardly moved to a position below the supporting unit 400, the side cover 320 is driven by the side frame 12 of the upper frame 10 to be stowed, and the supporting unit 400 is still supported to the side cover 320 of the bed cover 300 which is stowed.

The detached side frame 12 of the upper frame 10 can be fixed to the supporters 40, and the side frame 12 of the upper frame 10 is detachably connected to the supporters 40 such that the detached side frame 12 of the upper frame 10 can also be mounted back to the upper frame body 11. It will be understood that the detached side frame 12 of the upper frame 10 can also be fixed at other locations of the frame body 100, such as the supporting frame 20. The side frame 12 of the upper frame 10 may be clipped or sleeved to the supporters 40 or the supporting frame 20.

It is worth mentioning that, in the process of approaching the bed 2, the supporting unit 400 is closer to the bed 2 than the side frame 12 of the upper frame 10 which is mounted under the supporting unit 400, so that the supporting unit 400 is first contacted with the bed 2.

Specifically, the frame body 100 further comprises one or more third attachment devices 70 such as two third attachment devices 70, wherein each of the third attachment devices 70 comprises a third connecting member 71 and has a connecting cavity 710, wherein the third connecting member 71 is disposed on the supporters 40, and each connecting cavity 710 is formed in the side frame 12 of the upper frame 10. The third connecting member 71 is mated with the connecting cavity 710 such that the side frame 12 of the upper frame 10 is detachably connected to the corresponding supporters 40. The connecting cavities 710 are also respectively matched with both ends of the upper frame body 11.

The side frame 12 of the upper frame 10 is rotatably sleeved in the side cover 320 to adjust the location of the side frame 12 of the upper frame 10 conveniently such that each connecting cavity 710 is aligned with the third connecting member 71.

It is worth mentioning that each third connecting member 71 can be located on the supporters 40. Specifically, each third connecting member 71 can be located on the upper upright member 41 or the adjusting device 43 such that the relative position between the side frame 12 of the upper frame 10 and the supporting frame 20 is not affected during the process of adjusting the height of the supporters 40. That is, the relative position between the side frame 12 of the upper frame 10 and the lower upright member 42 is adjusted accordingly when adjusting the location of the upper upright member 41 of the supporters 40, but the relative position between the side frame 12 of the upper frame 10 and the upper frame body 11, the upper upright member 41, the supporting frame 20 and the frame body 100 is not be changed. That is the space provided by the crib 1 to the infant is not be varied with the changes of the height of the crib 1.

The upper frame 10 further comprises one or more locking device 13 which are respectively operatively connected to the upper frame body 11 and the side frame 12 of the upper frame 10. Each locking device 13 is used for locking the upper frame body 11 and the side frame 12 of the upper frame 10. The side frame 12 of the upper frame 10 is detachably connected to the upper frame body 11, the side cover 320 of the bed cover 300 is supported by the side frame 12 of the upper frame 10, and the side frame 12 of the upper frame 10 is separated from the upper frame body 11 when the side cover 320 is pulled by the infant inadvertently during the activity, so that the detachable side frame 12 of the upper frame 10 is a great safety hazard. When the side frame 12 of the upper frame 10 is mounted to the upper frame body 11, the side frame 12 of the upper frame 10 is able to be locked to the upper frame body 11 through the locking device 13 to avoid the accidental separation between the side frame 12 of the upper frame 10 and the upper frame body 11. The upper frame 10 has a locked state in which the side frame 12 of the upper frame 10 is fixedly connected to the upper frame body 11 and an unlocked state in which the side frame 12 of the upper frame 10 can be detached from the upper frame body 11.

Furthermore, in the above embodiment of the present invention, the lower frame 30 comprises a supporting body 31 and two movable members 32 which are respectively supported at both ends of the supporting body 31. Each movable member 32 may be a roller, such as a universal wheel or a lockable roller.

Reference to FIGS. 3A to 3F sequentially, when the detached crib 1 need to be reassembled to use, the assembly can be performed in accordance with the following steps.

The supporters 40 are first erected to support the upper frame body 11 of the upper frame 10, then each supporter 40 is elongated in length by upwardly lifting the upper upright member 41 so that the upper frame body 11 is supported at a certain height and also conducive to the subsequent installation steps.

The supporting frame 20 is then mounted to the upper upright member 41 of the supporters 40 from top to bottom, or the supporting frame 20 is inwardly and downwardly mounted to the upper upright member 41 of the supporters 40 from the side of the upper frame body 11, such that a relative location between the upper upright member 41 and the lower upright member 42 is adjusted, and then the relative location between the supporting frame 20 and the lower upright member 42 can be adjusted accordingly.

The bed cover 300 with the side frame 12 of the upper frame 10 is then attached to the upper frame body 11 of the upper frame 10. It is to be understood that the bed cover 300 may be attached to the upper frame body 11 of the upper frame 10, and then the side frame 12 of the upper frame 10 is mounted to the side cover 320 of the bed cover 300. The bed cover 300 has a high end and a low end, wherein the high end of the bed cover 300 is supported on the upper frame 10, and the low end of the bed cover 300 is supported on the supporting frame 20. The supporting unit 400 located on one side of the supporting frame 20 also plays a certain supporting for the bed cover 300, in particular the side cover 320 of the bed cover 300.

The side frame 12 of the upper frame 10 is then mounted to the upper frame body 11. A portion of the side cover 320 is connected to the bed cover body 310 detachably, and a portion of the side cover 320 is fixed to the bed cover body 310. The side cover 320 is connected to the bed cover body 310 detachably through the connector such as zipper. After the side cover 320 is supported by the side frame 12 of the upper frame 10 at a certain height, the zipper is pulled up so that the bed cover 300 only provides a surrounding structure, including the surrounding wall 301 and the bottom wall 302, around the upper frame and defines an upper opening 303.

The mattress 200 is then mounted to the bottom wall 302 formed by the bed cover 300, thereby obtaining a crib 1 that can be used. At this time, the crib 1 is in the fully expended state, as shown in FIG. 1. The crib 1 is able to be switched from the fully expended state to the bedside usage state.

Referring to FIGS. 4A to 4D, when the side frame 12 of the upper frame 10 is detached from the upper frame body 11, and then the side cover 320 of the bed cover 300 is turned outwardly and downwardly to fold up a part of the side cover 320. Due to the blocking action of the supporting unit 400, the side cover 320 cannot be completely stowed, and part of the side cover 320 is supported by the supporting unit 400.

The side frame 12 of the upper frame 10 is then mounted on each upper upright member 41 of the upright supporter 40 such that the side frame 12 of the upper frame 10 needs not be detached and can be fixed to each upper upright member 41 of the supporters 40 with the side cover 320 together.

At this time, due to the decrease in the height of the position of the side cover 320, the user can directly observe the state in the crib 1 on the side of the side cover 320. In other words, between the frame body 100 and the supporting frame 20, a receiving cavity 101 is defined for the bed cover 300 supported therein, wherein when the height of the surrounding wall 301 on that side of the bed cover 300 is decreased by folding down the side cover 320, the side opening 102 is formed for communicating the inside of the bed cover 300 supported in the receiving cavity 101 while the supporting unit 400 is held at the side opening 102. When the side cover 320 of the bed cover 300 is downwardly folded, the side opening 102 is exposed so that the user can observe the infant in the inside of the receiving cavity 100 on the side of the crib 1.

The crib 1 can be moved to the bedside and the height of the crib 1 is adjusted to adapt the height of the bed 2. The crib 1 is then fixed to the bed 2 by the fixing unit 500. At this time, the supporting unit 400 of the crib 1 is able to be firmly attached to the side of the bed 2 to avoid an excessive gap between the bed 2 and the crib 1.

Further, in this embodiment of the present invention, the crib 1 comprises an auxiliary reinforcing unit 600, wherein the auxiliary reinforcing unit 600 comprises two reinforcing members 610, wherein the reinforcing member 610 is connected and extended from the supporting unit 400 upwardly for the convenience of ensuring a safety performance of the crib 1, the two reinforcing members 610 enhances the stability of the supporting unit and functions to avoid or reduce the gap between the bed 2 and the crib 1.

Figure 4D:
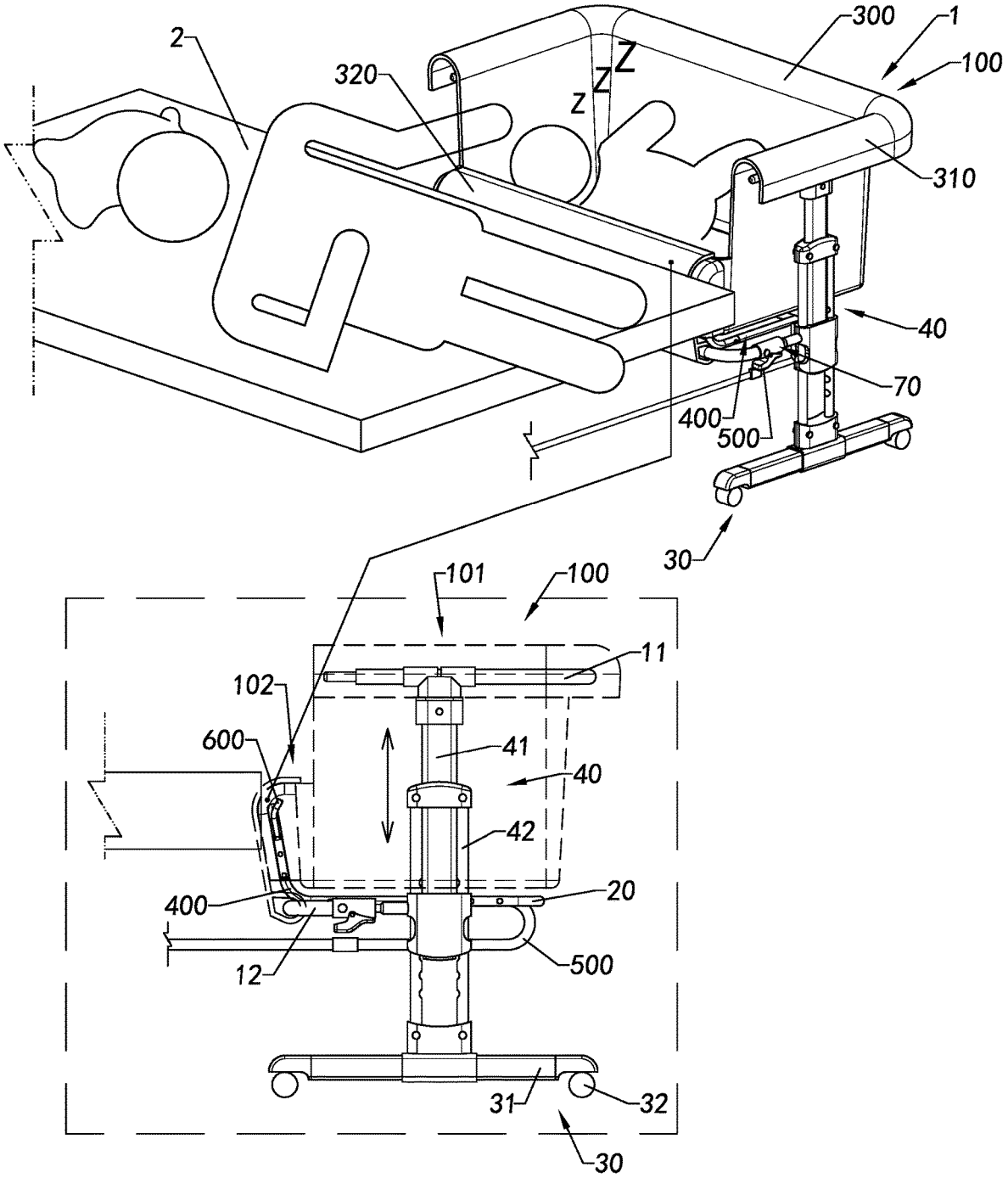

The auxiliary reinforcing unit 600 can provide a certain supporting role to a lower portion of the side of the surrounding wall 301 below the side cover 320, especially when the side cover 320 of the bed cover 300 is folded downwardly to construct as a supporting boundary frame of the bed cover 300 of the crib 1 for biasing against an adjacent side of the bed 2 as shown in FIG. 4D while retaining the containing shape of the crib 1. It will be appreciated that in other embodiments of the present invention, the crib 1 does not include the auxiliary reinforcing unit 600, because under some conditions, safety can be ensured just by the performance of the supporting unit 400, such as the arrangement as shown in FIG. 4C.

The supporting unit 400 is preferred to be made of a rigid and hard material, so that the supporting unit 400 has a certain structural strength, so as to prevent the transformation of the supporting unit 400 exceeds a certain range during use.

Specifically, for the supporting unit 400, the deformation of the supporting unit 400 may be caused by the infant in the crib 1 pushing the supporting unit 400 outwardly or the supporting unit 400 is pushed by the outside adult, for example, when the supporting unit 400 is in close contact with the side of the bed 2, the adult lying on the bed 2 squeezes the supporting unit 400. The deformation of the supporting unit 400 of the present invention in these cases can be maintained within a certain range to prevent the potential hazards.

Figure 5A:
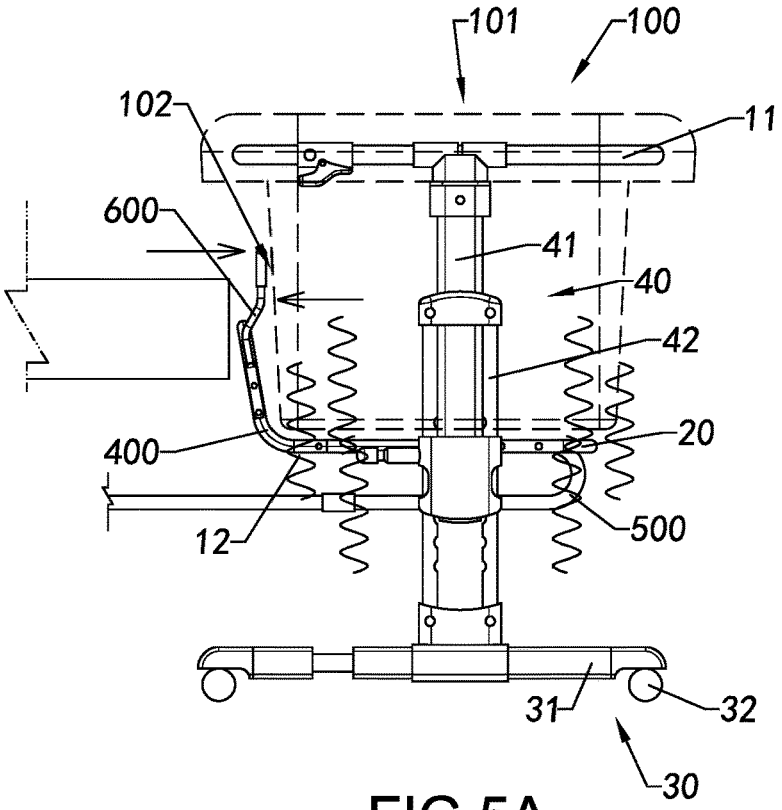
FIGS. 5A and 5B are schematic views illustrating a firm attachment between the crib and a bed according to the above preferred embodiment of the present invention.

For example, referring to FIG. 5A, when the supporting unit 400 is in close contact with the bed 2 or a platform, a pressure is directly applied to the supporting unit 400 or the reinforcing unit, thereafter, the deformation of the supporting unit 400 can be controlled within a certain range to prevent or reduce a gap between the supporting unit 400 and the mattress 200, or the supporting unit 400 is squeezed by an adult at the bedside and then drop out.

Accordingly, in a safety test, it is necessary to ensure the integrity of the crib 1 during the test and to ensure that the crib 1 remains being fixed to the bed 2 during foreseeable use and misuse. A 25 pounds force is a maximum force that the infant can apply to the product in the crib 1. A force of 50 pounds is a maximum force that an adult may apply to the crib 1 in sleep state when the crib 1 is assembled to the bedside usage state. The test strength is doubled considering the safety factor. In the test process, the supporting unit 400 needs to be held in the frame body 100. It is worth to mention that, during the use of the crib 1, the gap between the crib 1 and the bed 2 of the present invention should not exceed 13 mm in order to prevent death of the infant caused by getting struck into the gap. The supporting unit 400 of the present invention can be strong enough to avoid the gap exceed a certain level. In addition, if the two auxiliary reinforcing members 610 are introduced, when the supporting unit 400 is applied with force, the two auxiliary reinforcing members 610 provide further support to the supporting unit 400 at two opposite sides thereof so as to further ensure that the gap between the bed 2 and the crib 1 is within a predetermined safety range.

Figure 5B:
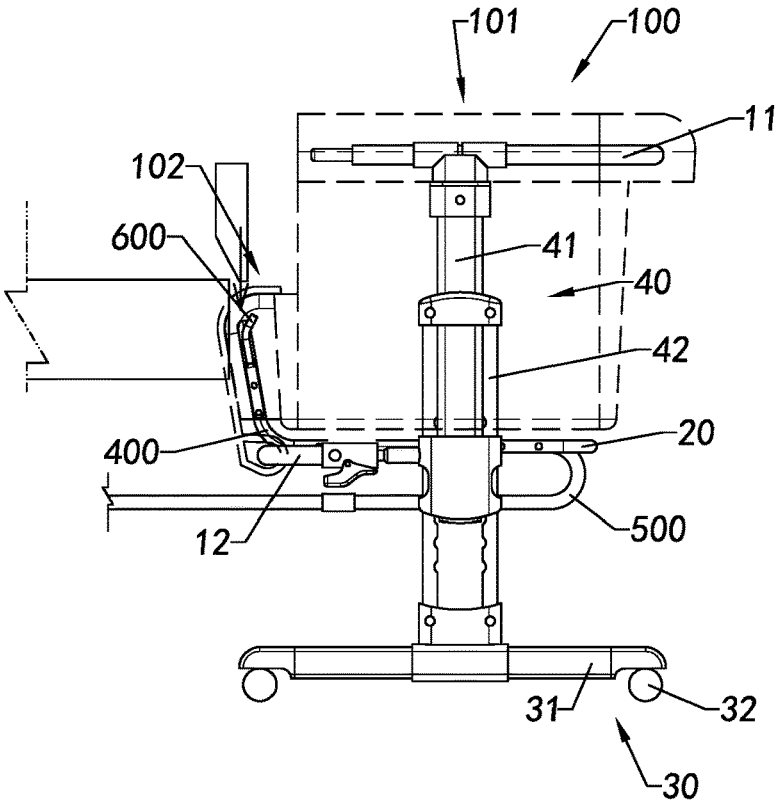

Furthermore, referring to FIG. 5B, when the supporting unit 400 of the present invention is in close connection with the bed 2 or a platform, a sharp wedge-shaped measuring rod can be inserted between the supporting unit 400 and the bed 2, the gap formed between the supporting unit 400 and the bed 2 in the preferred embodiment of the present invention is found to be maintained within a certain range under a certain pressure to prevent the infant inserting a hand or other object into the gap between the crib 1 and the bed 2.

Figure 6A:
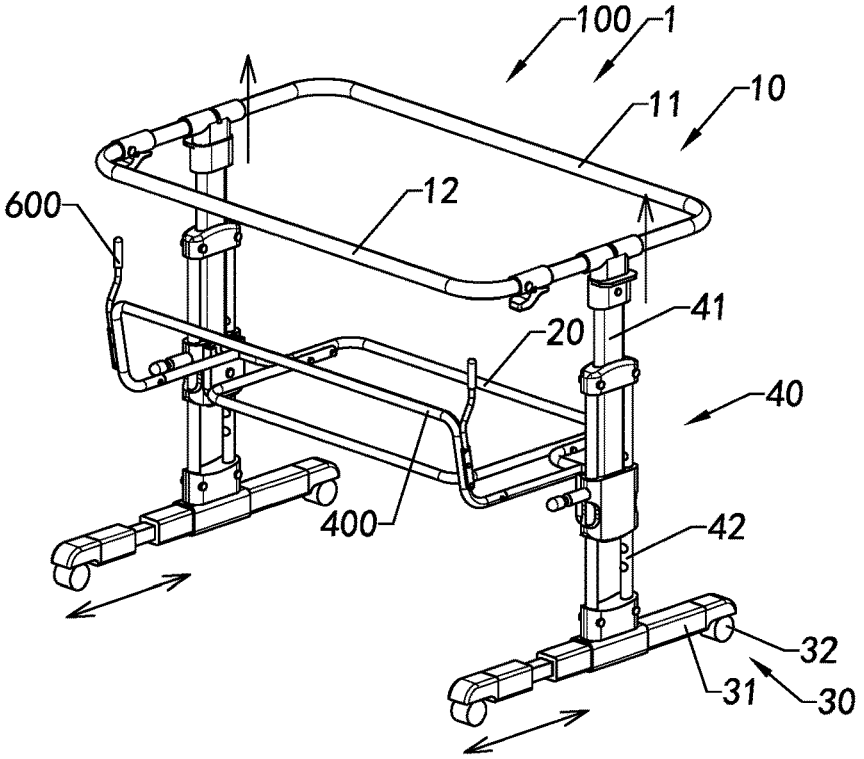
FIGS. 6A and 6B are schematic views illustrating the movement of movable members of a lower frame of the crib according to a first alternative mode of the above preferred embodiment of the present invention.
Figure 6B:
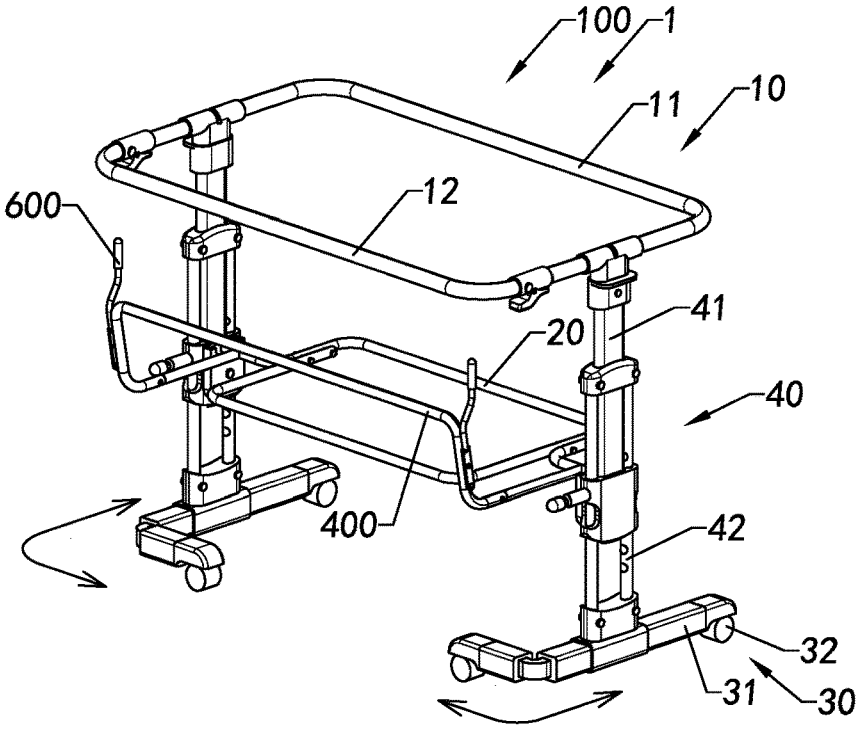

FIGS. 6A and 6B illustrate a first alternative mode of the crib 1 according to the present invention. The first alternative mode is different from the above embodiment in that the upper frame 10 and the supporters 40 of the crib 1 are detachable from each other. That is, the upper frame body 11 of the upper frame 10 is detachably connected to the high end of the two supporters 40.

The upper frame body 11 may be sleeved to the upper upright members 41 of the supporters 40. The upper frame body 11 may be snapped to the upper upright members 41 of the upright supporters 40, or the upper frame body may be screwed to the upper upright members 41 of the supporters 40.

Furthermore, in the above embodiment, the lower frame 30 is fixedly connected to the lower upright members 42 of the supporters 40, in the present embodiment, the lower frame 30 is detachably connected to the lower upright members 42 of the supporters 40.

Further, in the first alternative mode, the lower frame 30 comprises a supporting body 31 and two movable members 32 which are respectively supported at both ends of the supporting body 31. Each movable member 32 can be a roller, such as a universal wheel or a lockable roller. The lower frame 30 is disposed to be telescopic or foldable to vary the length of the lower frame 30. Referring to FIG. 6A, the lower frame 30 is telescopic extensible, and referring to FIG. 6B, the lower frame 30 is foldable to bend for a predetermined angle such as 90 degrees.

Because the supporting unit 400 is needed to be more close to outward to support at the side of the bed 2 relative to the lower frame 30, once the length of the lower frame 30 exceeds the position of the supporting unit 400, and the bed 2 near the ground is not provided with an accommodation for the lower frame 30, then the lower frame 30 is first in contact with the bed 2 with respect to the supporting unit 400, the side of the bed is resisted by the lower frame 30, and a large gap is formed between the supporting unit 400 and the bed 2. In this case, the adjustable lower frame 30 can be shortened the length so that the supporting unit 400 is supported on the side of the bed 2.

Figure 7A:
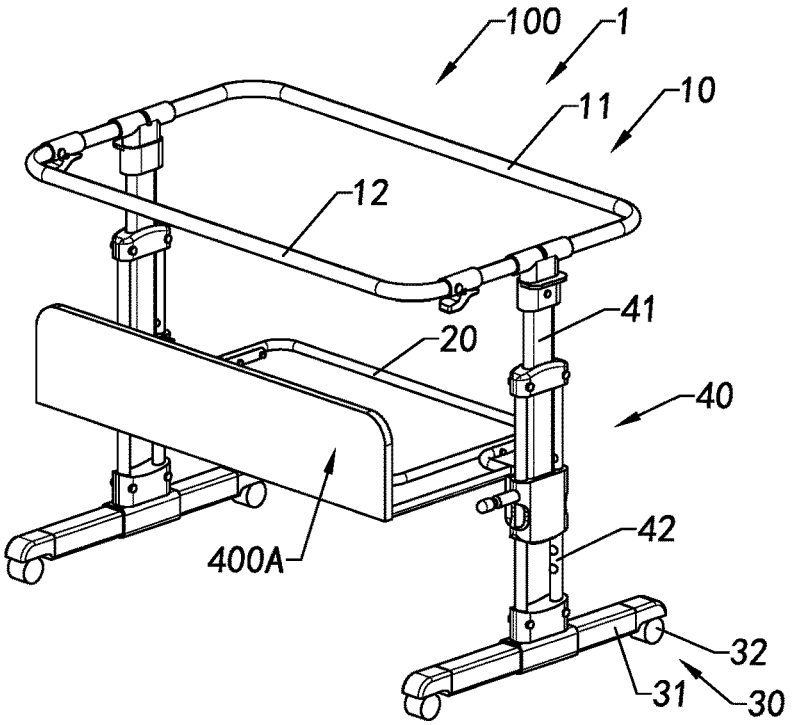
FIGS. 7A and 7B are schematic views of the crib according to a second alternative mode of the above preferred embodiment of the present invention.
Figure 7B:
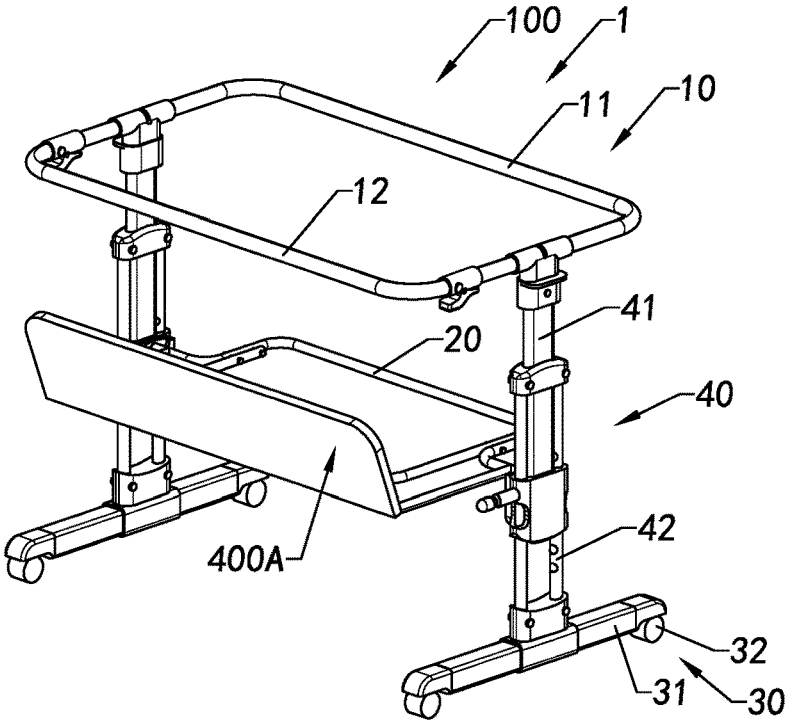

FIGS. 7A and 7B illustrate a second alternative of the crib 1 according to the above preferred embodiment of the present invention. The difference between the present second alternative mode and the above embodiment as described in FIGS. 1 to 3F is the supporting unit 400A. In the second alternative mode, the supporting unit 400A is embodied as a supporting plate and is supported by the supporting frame 20.

The supporting unit 400A may be located in a vertical position such that the supporting area is a planar area. The supporting unit 400A may be located at an inclined position, such as shown in FIG. 7B, such that the supporting area is a linear area.

Figure 8:
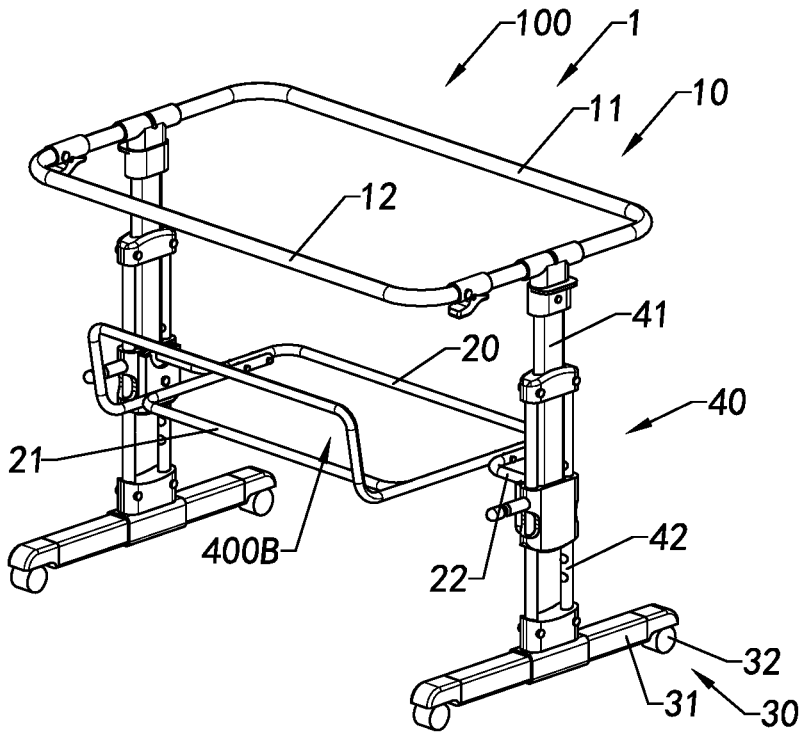
FIG. 8 is a schematic view of the crib according to a third alternative mode of the above preferred embodiment of the present invention.

FIG. 8 illustrates a third alternative mode of the crib 1 according to above preferred embodiment of the present invention. The difference between the third alternative mode and the above embodiment as described in the accompanying drawings FIGS. 1 to 3F is mainly in the supporting unit 400B.

The supporting frame 20 comprises a supporting frame body 21 and two supporting members 22 located at two sides of the supporting frame body 21 respectively, wherein the supporting members 22 located between the supporting frame body 21 and the supporters 40.

The supporting frame body 21 used for supporting a mattress, and the supporting members 22 used for supporting the supporting frame 20 to the supporters 40.

As shown in FIGS. 1 to 3F, the supporting unit 400 is connected to the supporting members 22. In the third alternative mode, the supporting unit 400B is connected to the supporting frame body 21. The supporting members 22 contribute to the supporting frame 20 in a size of a supporting area provided by the supporting frame body 21 for a mattress, which is smaller than the other supporting area provided by the upper frame 10 for the mattress.

Figure 9A:
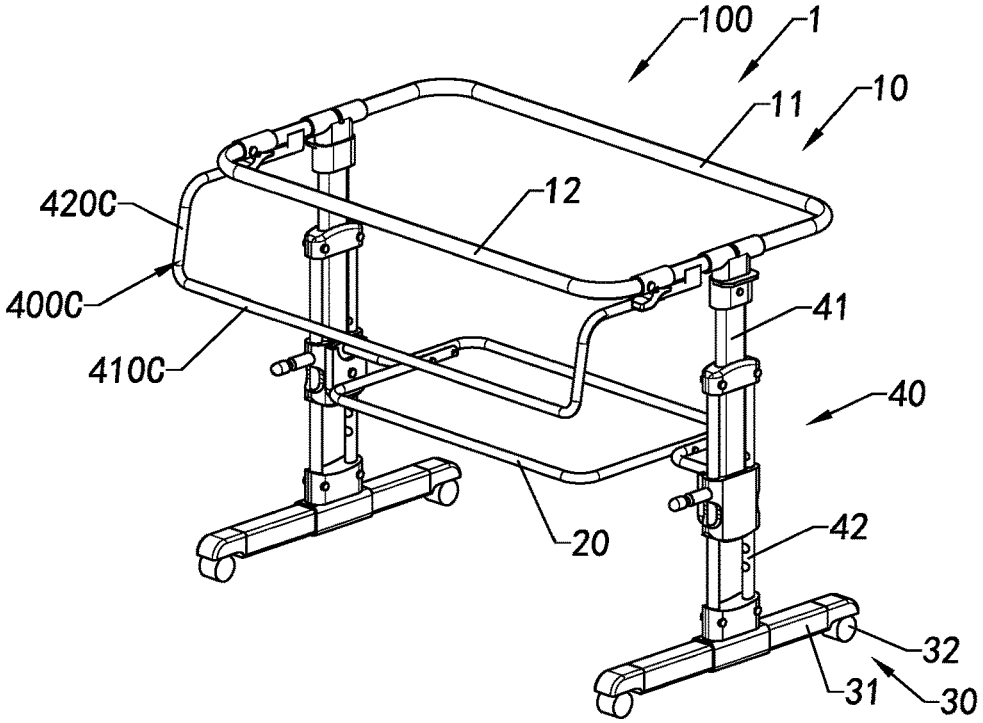
FIG. 9A is a schematic view of the crib according to a fourth alternative mode of the above preferred embodiment of the present invention.

FIG. 9A illustrates a fourth alternative mode of the crib 1 according to the above preferred embodiment of the present invention. The difference between the fourth alternative mode and the above preferred embodiment as described in FIG. 1 to FIG. 3F is mainly the supporting unit 400C.

In the fourth alternative mode, the supporting unit 400C is disposed to the upper frame 10. Specifically, the supporting unit 400C comprises a supporting crossbar 410C and two supporting arms 420C, wherein each of the supporting arms 420C is connected to the upper frame body 11, and the supporting crossbar 410C is supported by the supporting arms 420C.

Each of the supporting arms 420C comprises a high end and a low end, wherein the location of the high end of the supporting arm 420C is higher than the location of the low end of the supporting arm 420C. The high end of the supporting arm 420C is connected to the upper frame body 11 of the upper frame 10. The low end of the supporting arm 420C is connected to the supporting crossbar 410C. The supporting crossbar 410C is located between the two supporting arms 420C.

In the process of approaching the bed 2, the supporting crossbar 410C is closer to the bed 2 relative to the side frame 12 of the upper frame 10 mounted to below the supporting crossbar 410C to play a supporting role. The supporting crossbar 410C has a certain strength to maintain the deformation within a certain range during the fixing of the bed 2 and the crib 1.

Figure 9B:
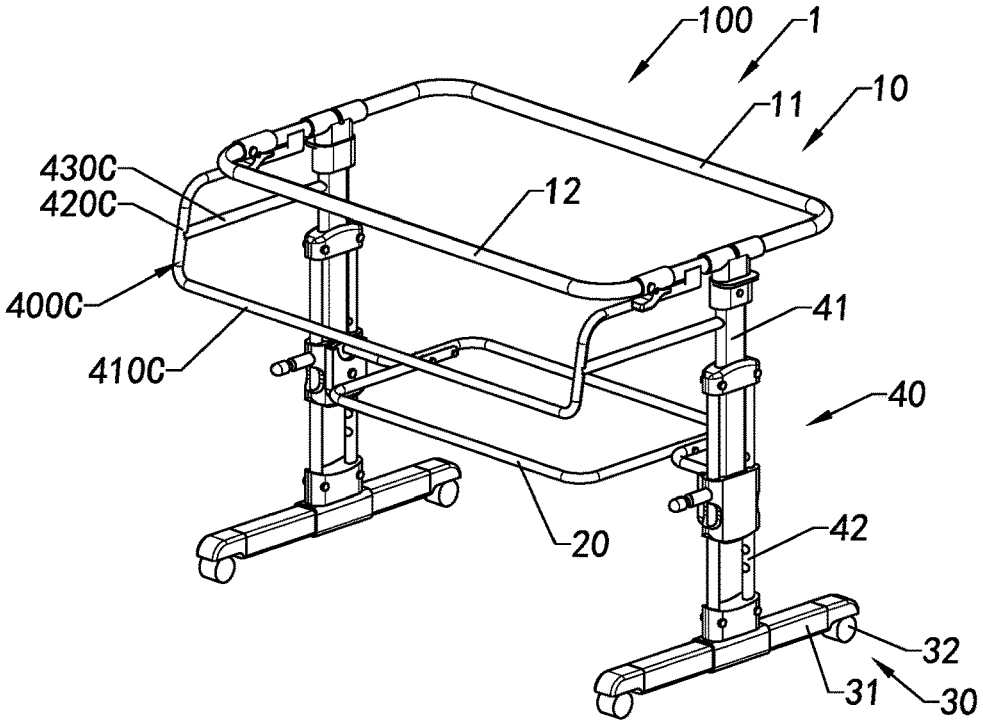
FIG. 9B is a schematic view of the crib according to a fifth alternative mode of the above preferred embodiment of the present invention.

FIG. 9B illustrates a fifth alternative mode of the crib 1 according to the above preferred embodiment of the present invention. The main difference between the fifth alternative mode and the above fourth alternative mode of the above preferred embodiment as described in FIG. 9A is the supporting unit 400C which further comprises an auxiliary supporting arm 430C, wherein the auxiliary supporting arm 430C is used for supporting the supporting crossbar 410C on the supporters 40.

Specifically, the auxiliary supporting arm 430C is located between the supporting crossbar 410C and the supporters 40, the supporting arm 420C, the auxiliary supporting arm 430C and the supporters 40 form a triangular structure to facilitate stable support for the supporting crossbar 410C.

In the other embodiments of the present invention, the auxiliary supporting arm 430C may be located between the supporting arm 420C and the supporters 40. That is, one end of the auxiliary supporting arm 430C may be connected to the one of the supporters 40, the other end of the auxiliary supporting arm 430 may be connected to the supporting crossbar 410C or the supporting arm 420C.

Figure 10A:
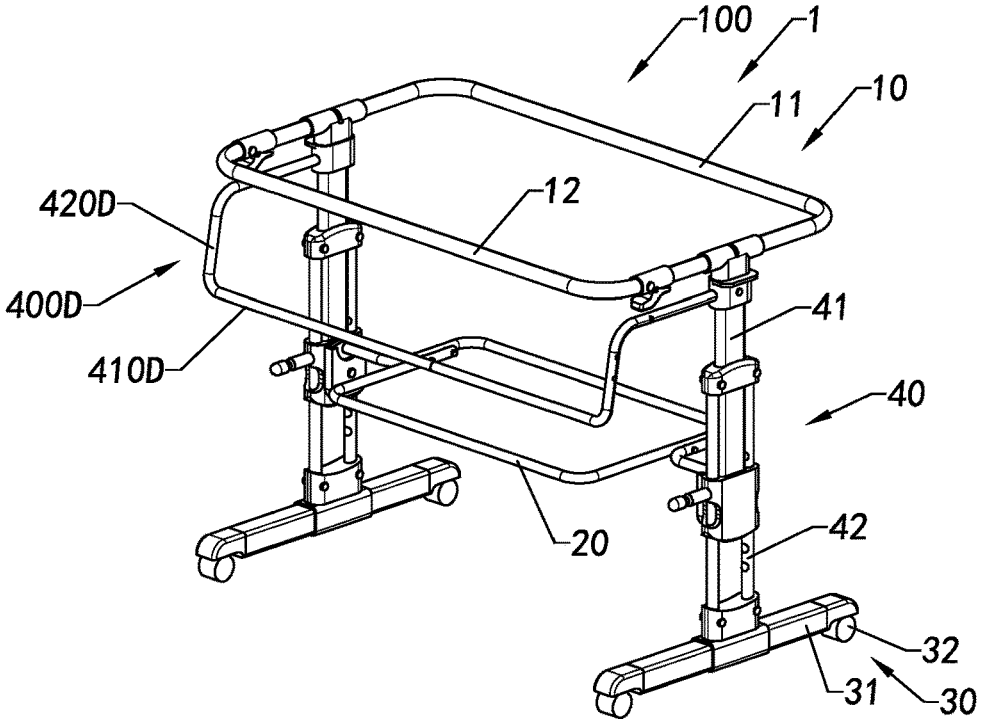
FIG. 10A is a schematic view of the crib according to a sixth alternative mode of the above preferred embodiment of the present invention.

FIG. 10A illustrates a sixth alternative mode of the crib 1 according to the above preferred embodiment of the present invention. The main difference between the sixth alternative mode and the above preferred embodiment as shown in FIGS. 1 to 3F is the supporting unit 400D.

In the sixth alternative mode, the supporting unit 400D is disposed to the upper upright members 41 of the supporters 40. The supporting unit 400D comprises a supporting crossbar 410D and two supporting arms 420D, wherein the each of supporting arms 420D is connected to the upper upright member 41 respectively.

It is worth to mention that the supporting arm 420D does not affect the adjustment of the relative position between the upper upright member 41 and the lower upright member 42. That is, when the upper upright right member 41 is pushed toward the lower upright member 42, the supporting arm 420D and the upper frame 10 move downward together with the upper upright member 41.

Optionally, the supporting unit 400D is detachably connected to the upper upright member 41 to facilitate transport and carrying of the crib 1.

Figure 10B:
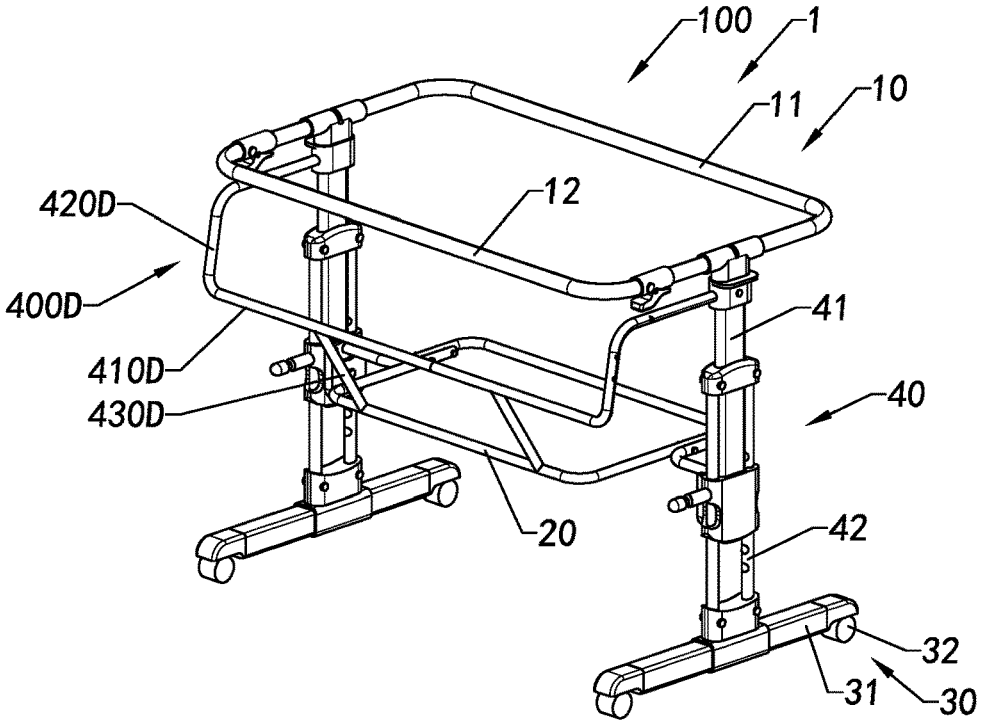
FIG. 10B is a schematic view of the crib according to a seventh alternative mode of the above preferred embodiment of the present invention.

FIG. 10B illustrates a seventh alternative mode of the crib 1 according to the above preferred embodiment of the present invention. In the seventh alternative mode, the supporting unit 400D is disposed to the upper upright members 41 of the supporters 40 and the supporting frame 20.

The supporting unit 400D further comprises at least two auxiliary supporting arms 430D, wherein the supporting arm 420D is connected to the supporting crossbar 410D and the upper upright member 41 of the corresponding supporter 40, and each of the auxiliary supporting arms 430D is connected to the supporting crossbar 410D and the supporting frame 20 respectively. Optionally, each auxiliary supporting arm 430D may be connected to the supporting arm 420D and the supporting frame 20. Optionally, the supporting unit 400D is detachably connected to the supporting frame 20 and the supporters 40.

Figure 11A:
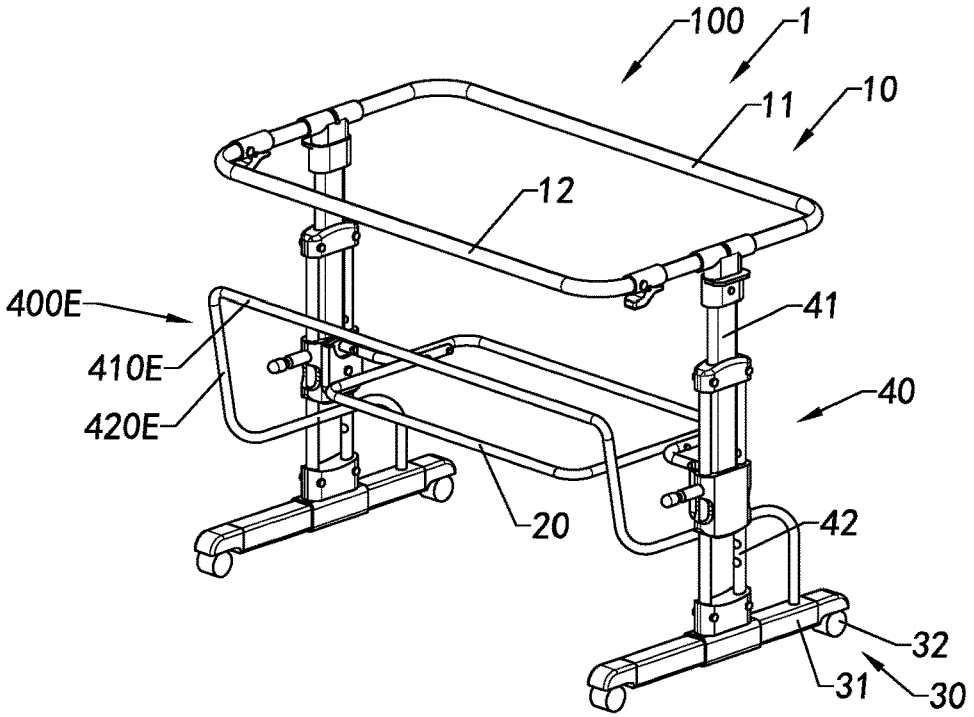
FIG. 11A is a schematic view of the crib according to an eighth alternative mode of the above preferred embodiment of the present invention.

FIG. 11A illustrates an eighth alternative mode of the crib 1 according to the above preferred embodiment of the present invention. In the eighth alternative mode, the supporting unit 400E is provided on the lower frame 30. The supporting unit 400E comprises a supporting crossbar 410E and two supporting arms 420E, wherein the supporting crossbar 410E is extended between the two supporting arms 420E.

The supporting arms 420E are respectively supported on two sides of the lower frame 30. The supporting arms 420E are extended upwardly to the supporting crossbar 410E. Optionally, the supporting unit 400E is detachably connected to the lower frame 30.

Figure 11B:
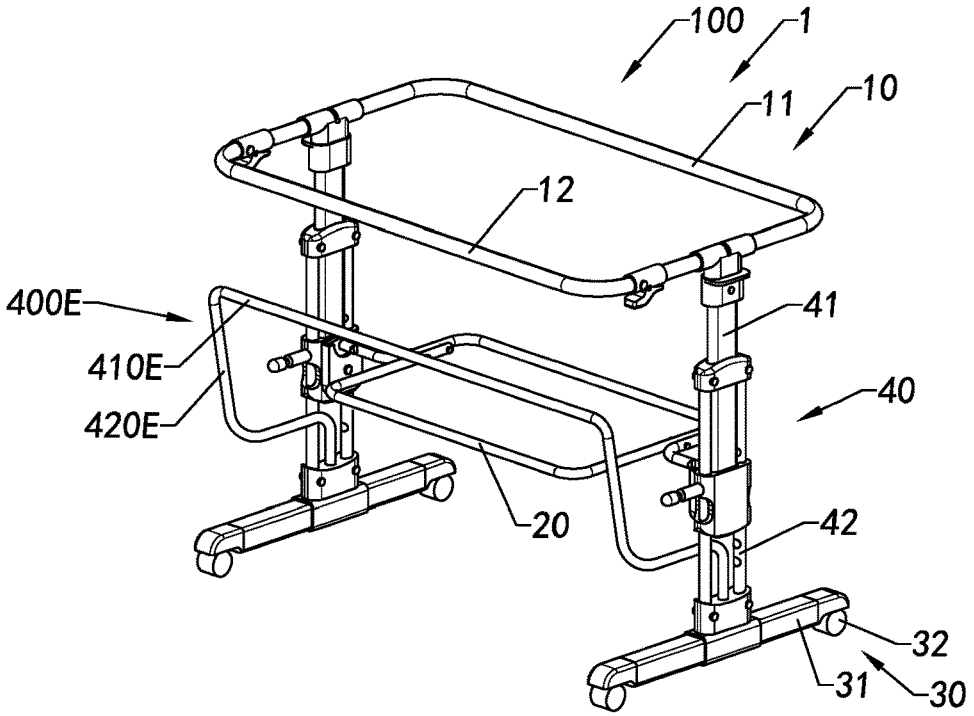
FIG. 11B is a schematic view of the crib according to a ninth alternative mode of the above preferred embodiment of the present invention.

FIG. 11B illustrates a ninth alternative mode of the crib 1 according to the above preferred embodiment of the present invention. In the ninth alternative mode, the supporting unit 400E is provided on the lower upright members 42 of the supporters 40. The supporting unit 400E comprises a supporting crossbar 410E and two supporting arms 420E, wherein the supporting crossbar 410E is extended between the two supporting arms 420E.

The two supporting arms 420E are respectively supported on two sides of the lower frame 30, and the supporting arm 420 are extended outwardly and upwardly from the lower frame 30 to the supporting crossbar 410E. Optionally, the supporting unit 400E is connected to the lower upright members 42 of the supporters 40.

Figure 11C:
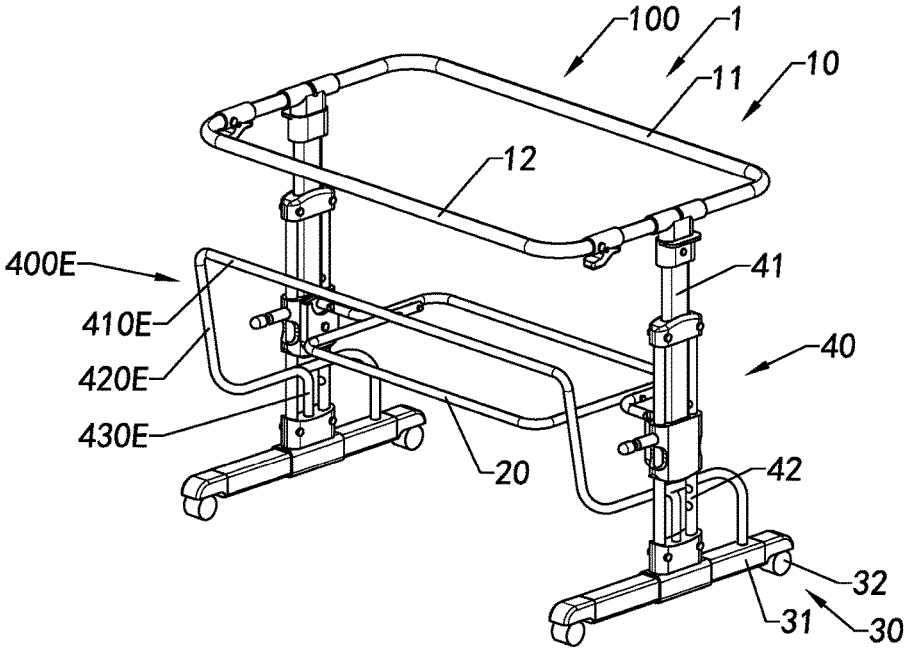
FIG. 11C is a schematic view of the crib according to a tenth alternative mode of the above preferred embodiment of the present invention.

FIG. 11C illustrates a tenth alternative mode of the crib 1 according to the above preferred embodiment of the present invention. In the tenth alternative mode, the supporting unit 400E is coupled on the supporters 40 and the lower frame 30.

The supporting unit 400E comprises a supporting crossbar 410E, two supporting arms 420E and two auxiliary supporting arms 430E, wherein the supporting crossbar 410E is extended between the two supporting arms 410E, and the two supporting arms 420E are respectively connected to the supporting crossbar 410E and the lower frame 30. The two auxiliary supporting arms 430E are respectively connected to the supporting crossbar 410E and the lower upright members 42. Optionally, the two auxiliary supporting arms 430E are respectively connected to the supporting arm 420E and the lower upright member 42. Optionally, the supporting unit 400E is detachably connected to the supporters 40 and the lower frame 30.

Figure 12A:
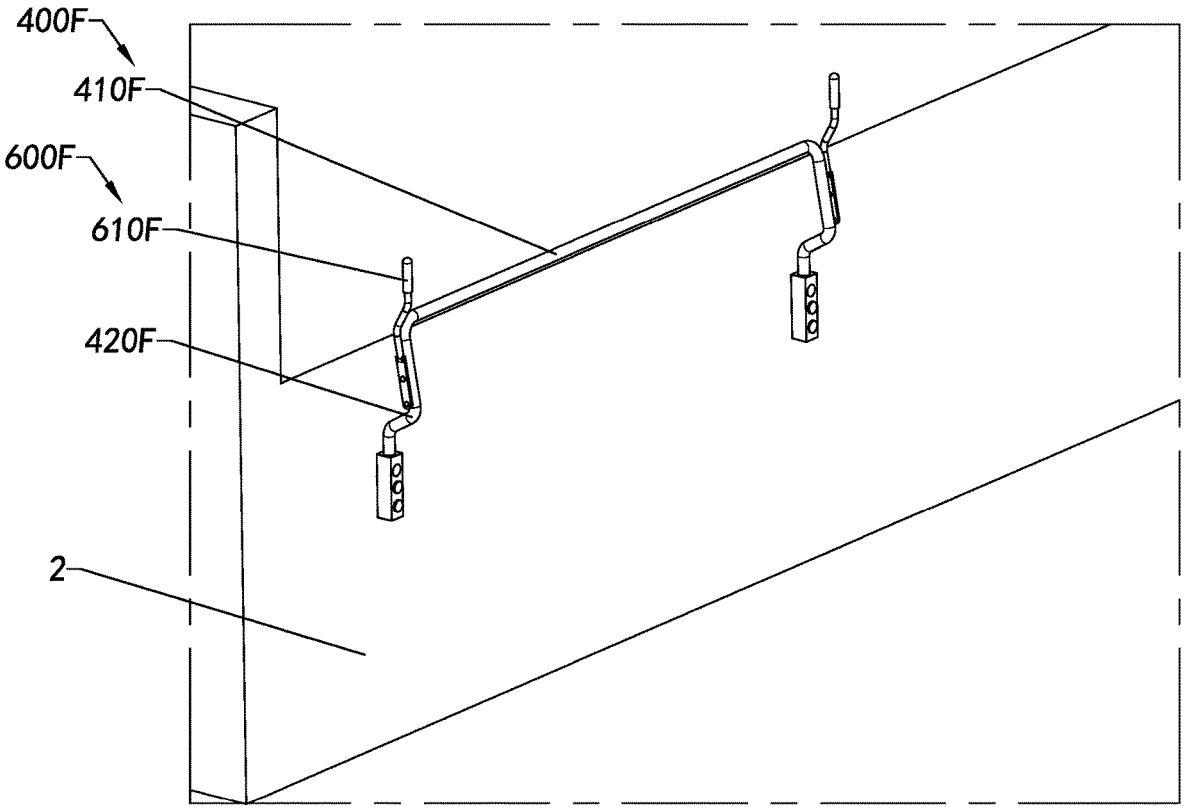
FIGS. 12A and 12B are schematic views of the crib according to an eleventh alternative mode of the above preferred embodiment of the present invention.
Figure 12B:
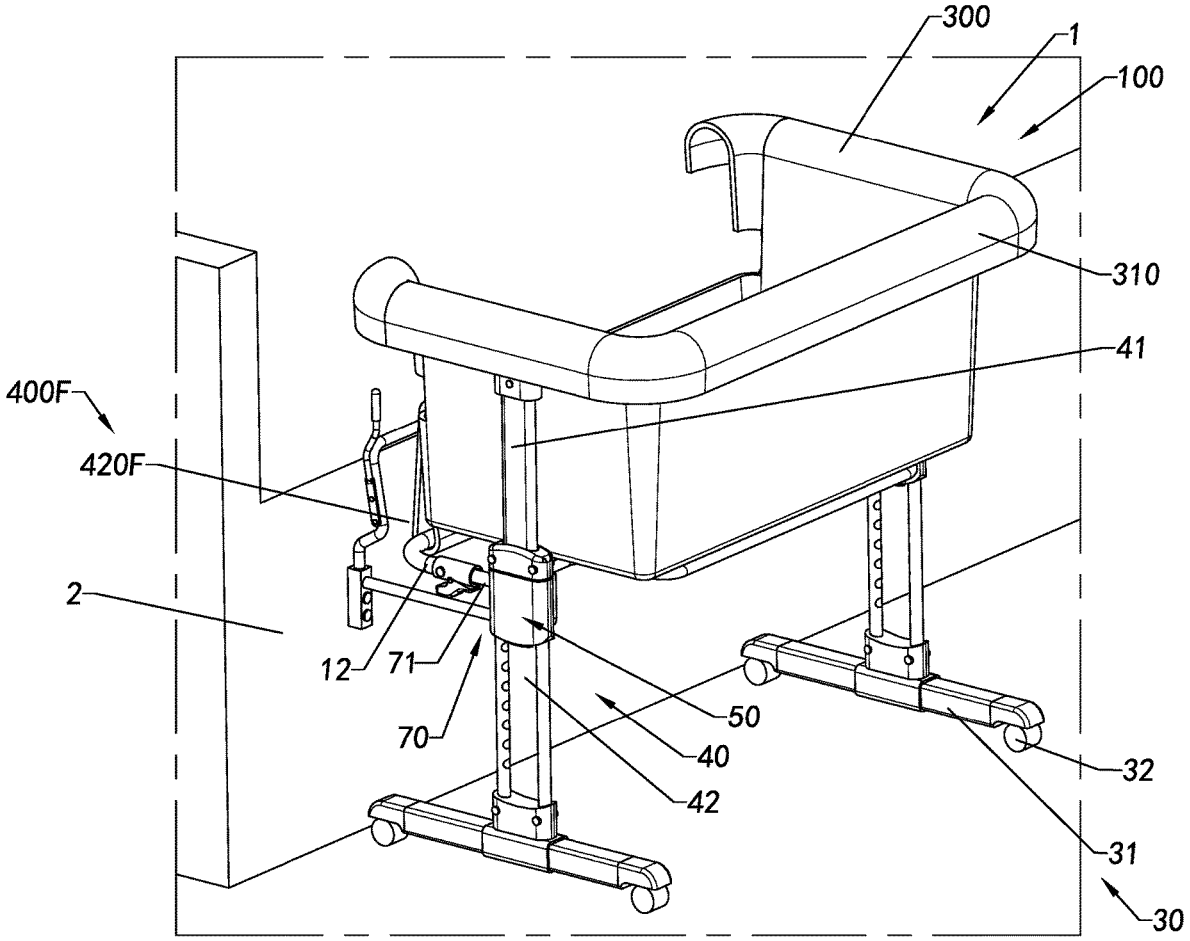

Referring to FIGS. 12A and 12B of the drawings, a crib 1 according to an eleventh alternative mode of the present invention is illustrated. In this eleventh alternative mode, the supporting unit 400F is assembled on the bed 2, and then the crib 1 can be detachably engaged with the supporting unit 400F which comprises the supporting cross bar 410F and two supporting arms 420F. In addition, an auxiliary reinforcing unit 600F comprising two reinforcing 610F may be connected to the two supporting arms 420F for enhancing the strength of the connection between the crib 1 and the bed 2.

According to another aspect of the present invention, a method of folding up the crib 1 described above comprises the following steps.

Disassemble the mattress 200 and the bed cover 300.

Disassemble the supporting frame 20.

Fold the supporters 40 and the lower frame 30 toward the upper frame 10.

According to some embodiments of the present invention, wherein in the above method, disassemble the upper frame 10 and the side frame 12 of the upper frame 10 while disassemble the bed cover 300.

According to some embodiments of the present invention, the above method further comprises a step of shorting the length of the supporters 40 before folding the supporters 40.

According to another aspect of the invention, an assembly method of the crib 1 described above comprises the following steps.

Unfold the supporters 40 to support the upper frame 10.

Mount the supporting frame 20 to the upper frame 10.

Mount the bed cover 300 and the mattress 200 to the upper frame 10.

According to some embodiments of the present invention, the above assembly method further comprises a step of mounting the side frame 12 of the upper frame 10 to the upper frame body 11 before mount the bed cover 300.

According to some embodiments of the present invention, in the above method, the supporters 40 are unfolded to be extending along a vertical direction and adjusting the height of the supporters 40.

According to some embodiments of the present invention, the method further comprises a step of disassembling the side frame 12 of the upper frame 10 to downwardly fold at least a part of the side cover 320 of the bed cover 300 mounted on the side frame 12 of the upper frame 10.

According to some embodiments of the present invention, the above assembly method further comprises a step of fixing the side frame 12 of the upper frame 10 and the side cover 320 at the bedside usage state.

According to some embodiments of the present invention, the assembly method further comprises a step of adhering the supporting unit 400 to the side of the bed 2.

According to some embodiments of the present invention, the assembly method further comprises a step of fixing the crib 1 to the bed 2 by the fixing unit 500.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A crib adapted for using alongside with a bed, comprising:

a frame body comprising a supporting frame being supported above ground and defining a receiving cavity;

a bed cover received in said receiving cavity and supported by said supporting frame for a height from ground, wherein said bed cover comprising a bottom wall and a surrounding wall extended upwardly surrounding said bottom wall under a support of said frame body, wherein said surrounding wall comprises at least a foldable side cover at a first side thereof, wherein said side cover is upfolded to form said surrounding wall with other sides thereof during a fully extended state of said crib, and that said side cover is folded downwardly to form a side opening at said first side of said surrounding wall during a bedside usage state of said crib;

a fixing unit coupled to said frame body for fixing said crib abutting a side of the bed for avoiding an excessive gap formed between the bed and said crib abutting the side of the bed, wherein said fixing unit is equipped with said frame body for adjusting a distance of said frame body such that said side opening at said first side of said surrounding wall of said bed cover is positioned alongside of the bed, wherein during said bedside usage state of said crib, when said side cover is folded down, a height of a position of said side cover is decreased for enabling a user on the bed directly observing an inside of said bed cover through said side opening while said fixing unit fixing said crib abutting the side of the bed; and a supporting unit formed on one side of said supporting frame and disposed at said first side of said surrounding wall below said side cover of said bed cover, and an auxiliary reinforcing unit which comprises two reinforcing members respectively extended at lateral sides of said supporting unit to positions above said supporting unit.

2. The crib, as recited in claim 1, wherein said bed cover comprises a bed cover body which comprises said bottom wall and said surrounding wall, wherein said first side of said surrounding wall has a height lower than said other sides of said surrounding wall to define said side opening, wherein said side cover is connected to said bed cover body to cover said side opening during said fully extended state of said crib and is capable of downwardly folding to lower a height of said surrounding wall at said first side to form said side opening for communicating with the inside of said bed cover and a bed surface of the bed.

3. The crib, as recited in claim 2, wherein said frame body further comprises one of more attachment devices and said side cover after folded down to form said side opening is able to detachably connect with said one or more attachment devices to retain a folded down position of said side cover and said side opening in opened condition.

4. The crib, as recited in claim 3, wherein a side portion of said side cover is connected to said bed cover body detachably and a bottom portion of said side cover is fixed to said bed cover body.

5. The crib, as recited in claim 2, wherein said fixing unit comprises one or more fastening elements for detachably fixing to the bed.

6. The crib, as recited in claim 5, wherein said fixing unit is coupled at said supporting frame and is able to be pulled out for being fixed to the bed.

7. The crib, as recited in claim 5, further comprising a supporting unit formed on one side of said supporting frame and disposed at said first side of said surrounding wall of said bed cover body below said side cover of said bed cover, wherein said supporting unit is supported to said side cover of said bed cover and has a supporting area which is configured for abutting a side of the bed when said bed cover is positioned alongside of the bed so as for reducing the excessive gap between said crib and said bed, such that said supporting unit is first contacted with the bed and closer to the bed than said supporting frame during said bedside usage state of said crib.

8. The crib, as recited in claim 7, wherein said supporting unit comprises a supporting crossbar and two supporting arms supporting said supporting crossbar to said supporting frame, wherein said two supporting arms are outwardly extended from said supporting frame and said supporting crossbar is connected between said two supporting arms to form said supporting area.

9. The crib, as recited in claim 2, further comprising a supporting unit formed on one side of said supporting frame and disposed at said first side of said surrounding wall of said bed cover body below said side cover of said bed cover, wherein said supporting unit is supported to said side cover of said bed cover and has a supporting area which is configured for abutting a side of the bed when said bed cover is positioned alongside of the bed so as for reducing the excessive gap between said crib and said bed, such that said supporting unit is first contacted with the bed and closer to the bed than said supporting frame during said bedside usage state of said crib.

10. A crib adapted for using alongside with a bed, comprising:

a frame body comprising a supporting frame being supported above ground and defining a receiving cavity;

a bed cover received in said receiving cavity and supported by said supporting frame for a height from ground, wherein said bed cover comprising a bottom wall and a surrounding wall extended upwardly surrounding said bottom wall under a support of said frame body, wherein said surrounding wall comprises at least a foldable side cover at a first side thereof, wherein said side cover is upfolded to form said surrounding wall with other sides thereof during a fully extended state of said crib, and that said side cover is folded downwardly to form a side opening at said first side of said surrounding wall during a bedside usage state of said crib, wherein said bed cover comprises a bed cover body which comprises said bottom wall and said surrounding wall, wherein said first side of said surrounding wall has a height lower than said other sides of said surrounding wall to define said side opening, wherein said side cover is connected to said bed cover body to cover said side opening during said fully extended state of said crib and is capable of downwardly folding to lower a height of said surrounding wall at said first side to form said side opening for communicating with the inside of said bed cover and a bed surface of the bed;

a fixing unit coupled to said frame body for fixing said crib abutting a side of the bed for avoiding an excessive gap formed between the bed and said crib abutting the side of the bed, wherein said fixing unit is equipped with said frame body for adjusting a distance of said frame body such that said side opening at said first side of said surrounding wall of said bed cover is positioned alongside of the bed, wherein during said bedside usage state of said crib, when said side cover is folded down, a height of a position of said side cover is decreased for enabling a user on the bed directly observing an inside of said bed cover through said side opening while said fixing unit fixing said crib abutting the side of the bed;

a supporting unit formed on one side of said supporting frame and disposed at said first side of said surrounding wall of said bed cover body below said side cover of said bed cover, wherein said supporting unit is supported to said side cover of said bed cover and has a supporting area which is configured for abutting a side of the bed when said bed cover is positioned alongside of the bed so as for reducing the excessive gap between said crib and said bed, such that said supporting unit is first contacted with the bed and closer to the bed than said supporting frame during said bedside usage state of said crib, wherein said supporting unit comprises a supporting crossbar and two supporting arms supporting said supporting crossbar to said supporting frame, wherein said two supporting arms are outwardly extended from said supporting frame and said supporting crossbar is connected between said two supporting arms to form said supporting area.

11. The crib, as recited in claim 10, wherein said frame body further comprises one of more attachment devices and said side cover after folded down to form said side opening is able to detachably connect with said one or more attachment devices to retain a folded down position of said side cover and said side opening in opened condition.

12. The crib, as recited in claim 10, further comprising a supporting unit formed on one side of said supporting frame and disposed at said first side of said surrounding wall of said bed cover body below said side cover of said bed cover, and an auxiliary reinforcing unit which comprises two reinforcing members respectively extended at lateral sides of said supporting unit to positions above said supporting unit.

13. The crib, as recited in claim 10, further comprising an auxiliary unit which comprises two reinforcing members connected to said two supporting arms respectively and extended at laterals sides of said two supporting arms and protrudedly extended to positions above said two supporting arms.

14. A crib adapted for using alongside with a bed, comprising:

a frame body comprising a supporting frame being supported above ground and defining a receiving cavity;

a bed cover received in said receiving cavity and supported by said supporting frame for a height from ground, wherein said bed cover comprising a bottom wall and a surrounding wall extended upwardly surrounding said bottom wall under a support of said frame body, wherein said surrounding wall comprises at least a foldable side cover at a first side thereof, wherein said side cover is upfolded to form said surrounding wall with other sides thereof during a fully extended state of said crib, and that said side cover is folded downwardly to form a side opening at said first side of said surrounding wall during a bedside usage state of said crib;

a fixing unit coupled to said frame body for fixing said crib abutting a side of the bed for avoiding an excessive gap formed between the bed and said crib abutting the side of the bed, wherein said fixing unit is equipped with said frame body for adjusting a distance of said frame body such that said side opening at said first side of said surrounding wall of said bed cover is positioned alongside of the bed, wherein during said bedside usage state of said crib, when said side cover is folded down, a height of a position of said side cover is decreased for enabling a user on the bed directly observing an inside of said bed cover through said side opening while said fixing unit fixing said crib abutting the side of the bed;

a supporting unit formed on one side of said supporting frame and disposed at said first side of said surrounding wall of said bed cover body below said side cover of said bed cover, wherein said supporting unit is supported to said side cover of said bed cover and has a supporting area which is configured for abutting a side of the bed when said bed cover is positioned alongside of the bed so as for reducing the excessive gap between said crib and said bed, such that said supporting unit is first contacted with the bed and closer to the bed than said supporting frame during said bedside usage state of said crib, wherein said supporting unit comprises a supporting crossbar and two supporting arms supporting said supporting crossbar to said supporting frame, wherein said two supporting arms are outwardly extended from said supporting frame and said supporting crossbar is connected between said two supporting arms to form said supporting area; and an auxiliary unit which comprises two reinforcing members connected to said two supporting arms respectively and extended at laterals sides of said two supporting arms and protrudedly extended to positions above said two supporting arms.

* * * * *